US007160158B2

(12) United States Patent
Kinoshita

(10) Patent No.: US 7,160,158 B2
(45) Date of Patent: Jan. 9, 2007

(54) ENGINE CONTROL ARRANGEMENT FOR WATERCRAFT

(75) Inventor: Yoshimasa Kinoshita, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/862,267

(22) Filed: Jun. 7, 2004

(65) Prior Publication Data

US 2005/0009419 A1 Jan. 13, 2005

(30) Foreign Application Priority Data

Jun. 6, 2003 (JP) ..... 2003-162808

(51) Int. Cl.
*B63H 21/21* (2006.01)

(52) U.S. Cl. ..... 440/1

(58) Field of Classification Search ..... 440/1, 440/2, 84, 87; 114/144 R
See application file for complete search history.

(56) References Cited

U.S. PATENT DOCUMENTS 4,423,630 A * 1/1984 Morrison ..... 73/379.01
4,556,005 A 12/1985 Jackson
4,949,662 A 8/1990 Kobayashi
4,961,396 A 10/1990 Sasagawa
4,971,584 A 11/1990 Inoue et al.
4,972,792 A 11/1990 Yokoyama et al.
4,989,533 A 2/1991 Horuichi
5,094,182 A 3/1992 Simner
5,113,777 A 5/1992 Kobayashi
5,167,547 A 12/1992 Kobayashi et al.
5,244,425 A 9/1993 Tasaki et al.
5,350,325 A 9/1994 Nanami
5,367,970 A 11/1994 Beauchamp et al.
5,429,533 A 7/1995 Kobayashi et al.
5,474,007 A 12/1995 Kobayashi
5,520,133 A 5/1996 Wiegert
5,538,449 A 7/1996 Richard
5,591,057 A 1/1997 Dai et al.
5,603,644 A 2/1997 Kobayashi et al.
5,697,317 A 12/1997 Pereira
5,707,264 A 1/1998 Kobayashi et al.
5,713,297 A 2/1998 Tani et al.
5,839,700 A 11/1998 Nedderman, Jr.
5,908,006 A 6/1999 Ibata
5,988,091 A 11/1999 Willis (Continued)

FOREIGN PATENT DOCUMENTS

CA 2271332 2/2000

(Continued)

OTHER PUBLICATIONS

Co-pending U.S. Appl. No. 11/083,290, filed Mar. 17, 2005. Title: Engine Control Device. Inventor: Ishida et al.

(Continued)

*Primary Examiner*—Ed Swinehart
(74) *Attorney, Agent, or Firm*—Knobbe, Martens, Olson & Bear, LLP

(57) ABSTRACT

A watercraft has an engine that is controlled to provide a comfortable and natural operational feeling during an off-throttle steering environment. The engine is controlled by detecting engine speed, using the detected engine speed to establish an accurate watercraft speed, and detecting an operator steering torque and operator engine torque request. An operational characteristic of the engine is adjusted to increase the engine output by a predetermined amount after a predetermined steering torque is measured and the watercraft is determined to be in a predetermined deceleration phase. The operational characteristic can be an increase in airflow to the engine.

25 Claims, 17 Drawing Sheets

U.S. PATENT DOCUMENTS 6,032,605 A 3/2000 Takashima
6,038,995 A 3/2000 Karafiath et al.
6,062,154 A 5/2000 Ito
6,086,437 A 7/2000 Murray
6,138,601 A 10/2000 Anderson et al.
6,159,059 A 12/2000 Bernier et al.
6,171,159 B1 1/2001 Shen et al.
6,174,210 B1 1/2001 Spade et al.
6,178,907 B1 1/2001 Shirah et al.
6,202,584 B1 3/2001 Madachi et al.
6,213,044 B1 4/2001 Rodgers et al.
6,216,624 B1 4/2001 Page
6,227,919 B1 5/2001 Blanchard
6,244,914 B1 6/2001 Freitag et al.
6,305,307 B1 10/2001 Yokoya
6,314,900 B1 11/2001 Samuelsen
6,332,816 B1 12/2001 Tsuchiya et al.
6,336,833 B1 1/2002 Rheault et al.
6,336,834 B1 1/2002 Nedderman, Jr. et al.
6,386,930 B1 5/2002 Moffet
6,390,862 B1 * 5/2002 Eichinger ..... 440/1
6,415,729 B1 7/2002 Nedderman, Jr. et al.
6,428,372 B1 8/2002 Belt
6,443,785 B1 9/2002 Swartz et al.
6,478,638 B1 * 11/2002 Matsuda et al. ..... 440/1
6,508,680 B1 1/2003 Kanno
6,511,354 B1 1/2003 Gonring et al.
6,523,489 B1 2/2003 Simzrd et al.
6,530,812 B1 3/2003 Koyano et al.
6,668,796 B1 12/2003 Umemoto et al.
6,695,657 B1 2/2004 Hattori
6,709,302 B1 3/2004 Yanagihara
6,709,303 B1 3/2004 Umemoto et al.
6,722,932 B1 4/2004 Yanagihara
6,733,350 B1 5/2004 Iida et al.
6,827,031 B1 12/2004 Aoyama
6,855,014 B1 2/2005 Kinoshita et al.
7,037,147 B1 5/2006 Kinoshita et al.
2002/0049013 A1 * 4/2002 Kanno ..... 440/88
2003/0000500 A1 1/2003 Chatfield
2004/0069271 A1 4/2004 Kanno et al.
2004/0147179 A1 7/2004 Mizuno et al.
2005/0085141 A1 4/2005 Motose
2005/0263132 A1 12/2005 Yanagihara
2005/0273224 A1 12/2005 Ito et al.
2005/0287886 A1 12/2005 Ito et al.
2006/0004502 A1 1/2006 Kaneko et al.
2006/0037522 A1 2/2006 Kaneko et al.

FOREIGN PATENT DOCUMENTS

JP 2001-329881 11/2001
WO WO 00/40462 7/2000

OTHER PUBLICATIONS

Co-pending U.S. Appl. No. 11/335,996, filed Jan. 20, 2006. Title: Operation Control System for Small Boat. Inventor: Kinoshita et al.
Co-pending U.S. Appl. No. 11/336,711, filed Jan. 20, 2006. Title: Operation Control System for Planing Boat. Inventor: Kinoshita et al.
Advertisement for trim adjuster for Sea-Doo watercraft—Personal Watercraft Illustrated, Aug. 1998.
Advertisement for trim adjuster—Jet Sports, Aug. 1997.
Advertisement for Fit and Trim and Fit and Trim II—Jet Sports. Aug. 1996.

* cited by examiner

ENGINE CONTROL ARRANGEMENT FOR WATERCRAFT

PRIORITY INFORMATION

This application is based on and claims priority to Japanese Patent Application No. 2003-162808, filed Jun. 6, 2003, the entire contents of which is hereby expressly incorporated by reference.

BACKGROUND OF THE INVENTIONS

1. Field of the Inventions

The present application generally relates to an engine control arrangement for controlling a watercraft, and more particularly relates to an engine management system that provides a natural watercraft operational feeling during decelerating turns.

2. Description of the Related Art

Watercraft, including personal watercraft and jet boats, are often powered by an internal combustion engine having an output shaft arranged to drive a water propulsion device. Occasionally, deceleration occurs while turning and, because watercraft maneuver according to the amount of water being propelled from its jet pump, engine speed affects turning speed.

In a deceleration turning state, some current watercraft steering aids can give the watercraft operator an uncomfortable feeling. This uncomfortable feeling can be caused by sudden engine acceleration to aid in steering the watercraft or by an elongated decreasing engine speed process to aid in steering the watercraft.

SUMMARY OF THE INVENTIONS

An embodiment of at least one of the inventions disclosed herein includes a method of controlling a marine engine associated with a watercraft. The watercraft includes a steering device operable by a rider of the watercraft, an engine, and an engine power output request device operable by a rider of the watercraft. The method comprises determining a deceleration of the watercraft when the watercraft is at an elevated watercraft speed, detecting a steering force applied to the steering device, and controlling the power output of the engine such that the power output of the engine is greater than that corresponding to a state of the power output request device and based on the detected steering force during the detected deceleration.

Another embodiment of at least one of the invention disclosed herein is directed to a watercraft comprising a hull, a steering device operable by a rider of the watercraft, an engine, an engine power output request device operable by a rider of the watercraft, and a controller. The controller is configured to determine a deceleration of the watercraft when the watercraft is at an elevated watercraft speed, to detect a steering force applied to the steering device, and to control the power output of the engine such that the power output of the engine is greater than that corresponding to a state of the power output request device and based on the detected steering force during the deceleration.

Another embodiment of at least one of the invention disclosed herein is directed to a watercraft comprising a hull, a steering device operable by a rider of the watercraft, an engine, and an engine power output request device operable by a rider of the watercraft. The watercraft also includes means for determining a deceleration of the watercraft when the watercraft is at an elevated watercraft speed, a sensor for detecting a steering force applied to the steering device, and means for controlling the power output of the engine such that the power output of the engine is greater than that corresponding to a state of the power output request device and based on the detected steering force during deceleration.

BRIEF DESCRIPTION OF THE DRAWINGS

These and other aspects of the present inventions are described in detail below with reference to the accompanying drawings. The drawings comprise 17 figures.

DETAILED DESCRIPTION OF THE PREFERRED EMBODIMENT

Figure 1:
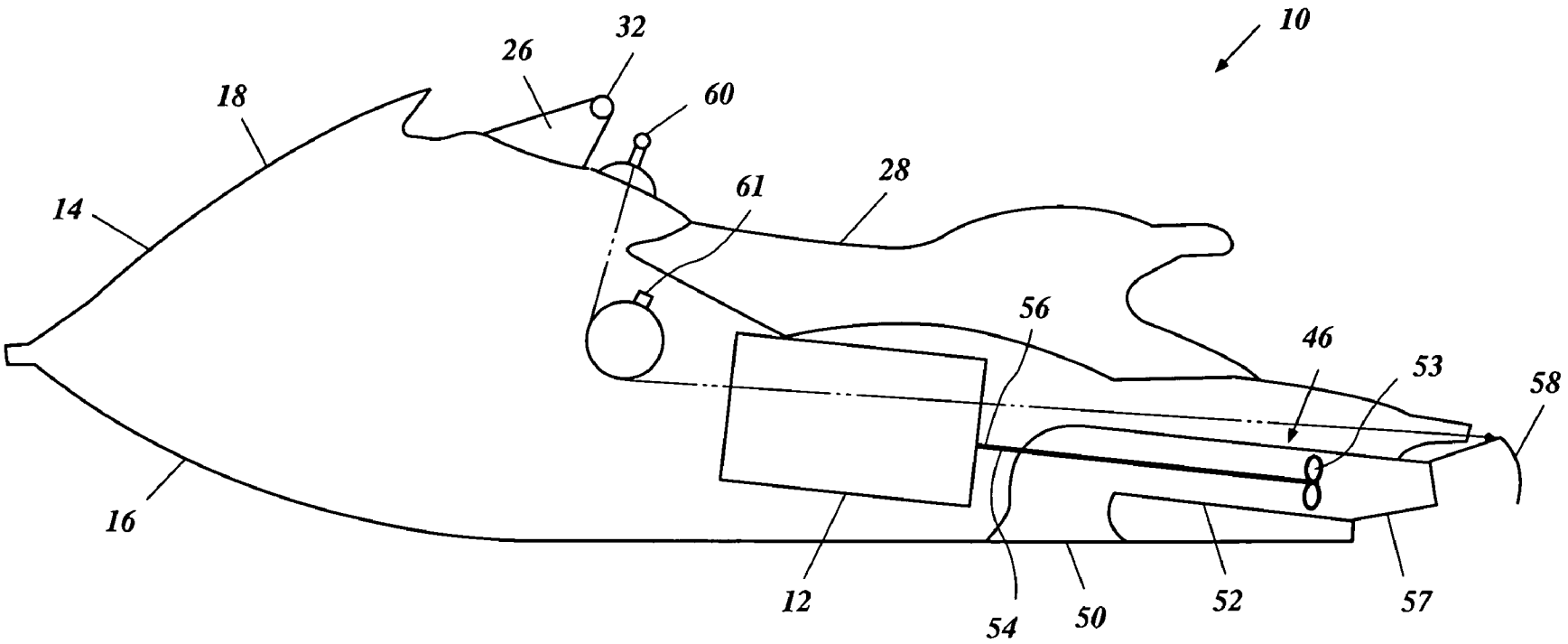
FIG. 1 is a side elevational view of a personal watercraft of the type powered by an engine controlled in accordance with a preferred embodiment.
Figure 2:
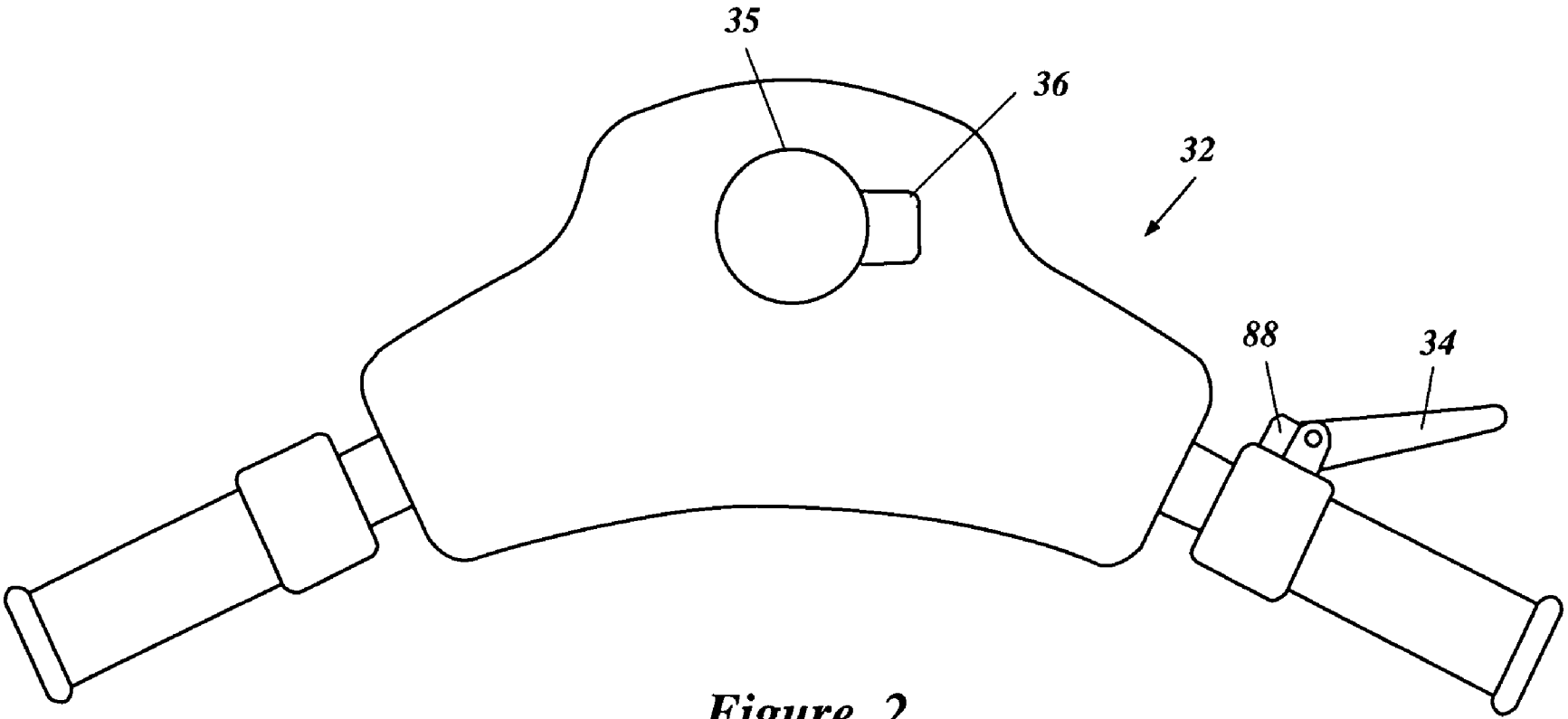
FIG. 2 is a top plan view of a handlebar steering assembly including a steering torque sensor as well as a throttle lever and a throttle lever position sensor.
Figure 3:
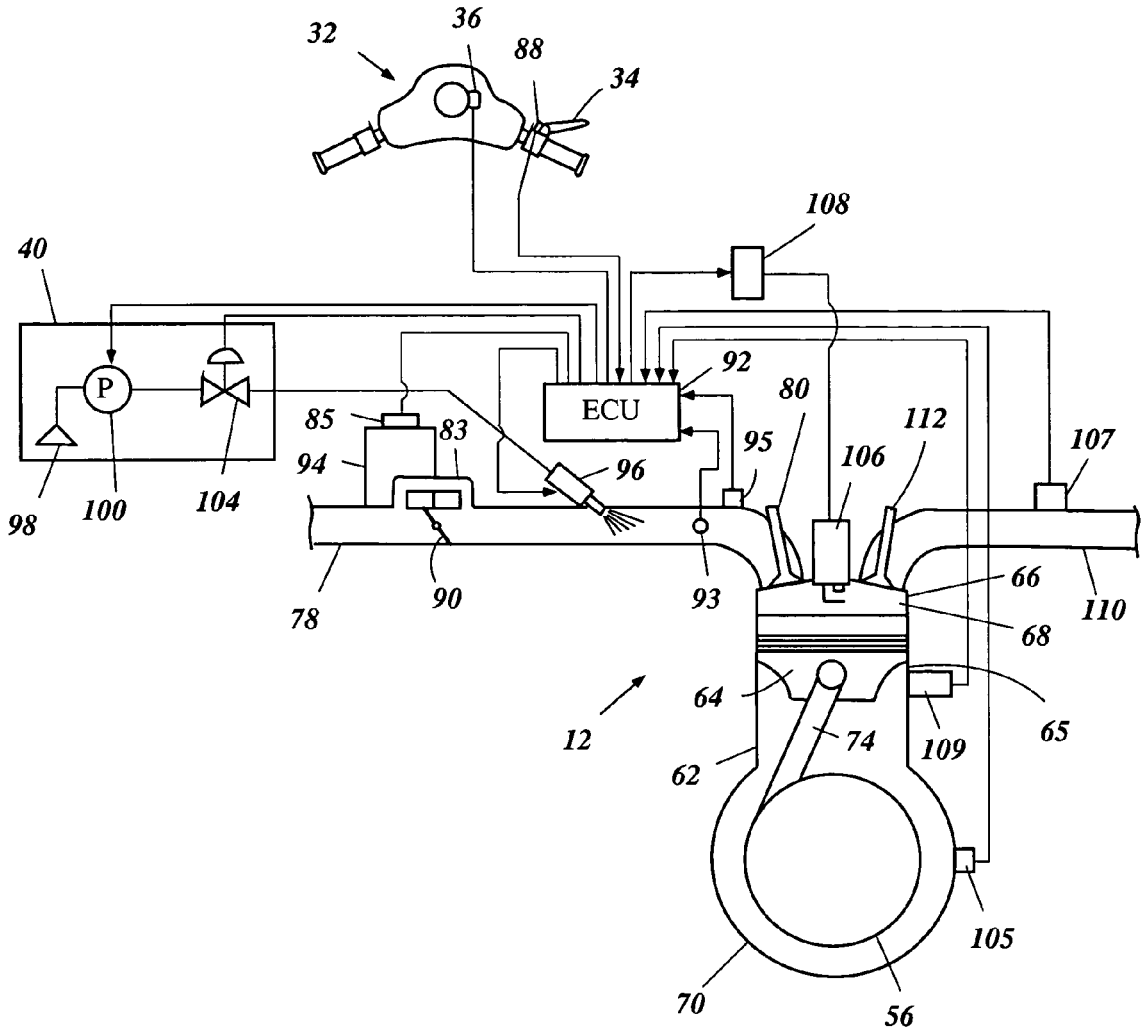
FIG. 3 is a schematic view showing the engine control system, including at least a portion of the engine in cross-section, an ECU, and a simplified fuel injection and simplified steering system.

With reference to FIGS. 1 to 3, an overall configuration of an engine control system, a personal watercraft 10 and its engine 12 is described. The watercraft 10 employs the internal combustion engine 12, which is configured in accordance with a preferred embodiment. The described engine configuration and the associated control routines have particular utility for use with personal watercraft, and thus, are described in the context of personal watercraft. The engine configuration and the control routine, however, also can be applied to other types of watercraft, such as, for example, small jet boats and other vehicles that rely on jet drives or other similar propulsion systems.

With reference initially to FIG. 1, the personal watercraft 10 includes a hull 14 formed with a lower hull section 16 and an upper hull section or deck 18. The lower hull section 16 and the upper hull section 18 preferably are coupled together to define an internal cavity.

A control mast 26 extends upwardly to support a handlebar 32. The handlebar 32 is provided primarily for controlling the direction of the watercraft 10. The handlebar 32 preferably carries other mechanisms, such as, for example, a throttle lever 34 that is used to control the engine output (i.e., to vary the engine speed). The handlebar 32 rotates about a steering shaft 35 that allows the handlebar 32 to rotate left or right within a predetermined steering angle. A portion of the steering shaft 35 can be mounted relative to the hull 14 with at least one bearing so as to allow the shaft to rotate relative to the hull. The shaft 35 can also be formed in sections that are configured to articulate relative to one another. For example, the shaft sections can be configured for a tilt steering mechanism allowing an angle of inclination of a upper portion of the shaft to be adjustable while a lower section of the shaft 35 remains at a fixed angle of inclination. In some embodiments, the sections can be connected through what is commonly referred to as a "universal joint". However, other types of tilt steering mechanisms can also be used.

A steering torque sensor 36 can be configured to determine the amount of steering torque applied to the handlebar 32. For example, but without limitation, the steering torque sensor 36 can be configured to detect a magnitude of a force applied to the handlebar 32 when the handlebar 32 is turned past a predetermined handlebar angle. The steering torque sensor 36 can be constructed in any known manner. In one exemplary but non-limiting embodiment, the torque sensor 36 can be configured to work in conjunction with stoppers commonly used on watercraft steering mechanisms to define the maximum turning positions.

For example, as noted above, the handlebar 32 rotates about a steering shaft 35. In at least one embodiment, the steering shaft can include a finger member rigidly attached to the shaft and extending radially outwardly relative to the steering shaft 35. One or a plurality of stoppers can be used to define the maximum angular positions of the handlebar 32. For example, the stopper or stoppers can be mounted in the vicinity of the finger member such that when the handlebar 32 is turned, thereby causing the finger member to rotate along with the shaft, the finger member eventually contacts left and right maximum position surfaces defined by the stopper(s). In one exemplary but non-limiting embodiment, the stopper(s) can be disposed such that the handlebar 32 can rotate about 15–25 degrees in either direction before contacting the stopper(s).

As noted above, the torque sensor 36 can be configured to work in conjunction with the stoppers and finger member. For example, pressure sensors can be provided on each of the maximum position surfaces defined by the stopper(s). These pressure sensors can be connected to an Electronic Control Unit (ECU) 92 described below, so as to provide the ECU 92 with signals representing a force at which the handlebar 32, and thus the finger member, is pressed against the stopper(s). In some embodiments, at least one pressure sensor can be mounted on the finger member. Such a sensor can be in a form commonly referred to as a "load cell.". Thus, when this sensor is pressed against the stopper(s), signals can be sent to the ECU 92 indicative of the steering force applied to the handlebar 32. In some embodiments, the pressure sensor(s), regardless of weather they are mounted to the finger member or the stopper(s), can be mounted with or be incorporated into a spring, and thereby allow some additional rotation of the handlebar 32 after the stopper is initially contacted. In another exemplary, but non-limiting embodiment, the stopper(s) and sensor(s) can be mounted such that initial contact occurs when the handlebar 32 is turned about 19 degrees from a center position. As used herein, the term "initial contact" merely referees to when the pressure sensor(s) is first contact by a stopper of the finger member, such that the sensor(s) is pressed between the finger member and the corresponding stopper member.

As additional steering force is applied to the handlebar 32, the pressure sensor and/or an associated spring can deflect, allowing the handlebar 32 to be turned an additional amount. Additionally, the signal emitted from the steering sensor 36 changes so as to indicate an increasing steering force as the force applied to the handlebar 32 is increased. Regardless of the particular arrangement used for generating the steering force signal, the use of a steering force sensor provides additional advantages in providing a more comfortable riding experience during off throttle steering control, described in greater detail below.

A seat 28 is disposed atop a pedestal. In the illustrated arrangement, the seat 28 has a saddle shape. Hence, a rider can sit on the seat 28 in a straddle fashion and thus, the illustrated seat 28 often is referred to as a straddle-type seat.

A fuel tank 40 (FIG. 3) is positioned in the cavity under the bow portion of the upper hull section 18 in the illustrated arrangement. A duct (not shown) preferably couples the fuel tank 40 with a fuel inlet port positioned at a top surface of the bow of the upper hull section A closure cap closes the fuel inlet port to inhibit water infiltration.

The engine 12 is disposed in an engine compartment. The engine compartment preferably is located under the seat 28, but other locations are also possible (e.g., beneath the control mast 26 or in the bow). The rider thus can access the engine 12 in the illustrated arrangement through an access opening by detaching the seat 28. In general, the engine compartment can be defined by a forward and rearward bulkhead. Other configurations, however, are also possible.

A jet pump unit 46 propels the illustrated watercraft 10. Other types of marine drives can be used depending upon the application. The jet pump unit 46 preferably is disposed within a tunnel formed on the underside of the lower hull section 16. The tunnel has a downward facing inlet port 50 opening toward the body of water. A jet pump housing 52 is disposed within a portion of the tunnel. Preferably, an impeller 53 is supported within the housing 52.

An impeller shaft 54 extends forwardly from the impeller and is coupled with a crankshaft 56 of the engine 12 by a suitable coupling member (not shown). The crankshaft of the engine 12 thus drives the impeller shaft 54. The rear end of the housing 52 defines a discharge nozzle 57. A steering nozzle (not shown) is affixed proximate the discharge nozzle 57. The nozzle can be pivotally moved about a generally vertical steering axis. The steering nozzle is connected to the handle bar 32 by a cable or other suitable arrangement so that the rider can pivot the nozzle for steering the watercraft.

A reverse bucket mechanism 58 can advantageously at least partially cover the discharge nozzle 57 allowing at least some of the water that is discharged from the discharge nozzle 57 to flow towards the front of the watercraft 10. This flow of water towards the front of the watercraft 10 moves the watercraft in the reverse direction. A reverse lever 60 that activates the reverse bucket mechanism 58 is located in the vicinity of the control mast 26. A reverse switch 61 is positioned between the reverse lever 60 and the reverse bucket mechanism 58. The reverse switch 61 is activated whenever the reverse bucket mechanism 58 is placed in a position that allows the watercraft 10 to travel in the reverse direction.

With reference to FIG. 3, the engine 12 according to one preferred embodiment of the present invention as illustrated in FIG. 3 operates on a four-stroke cycle combustion principal. The engine 12 includes a cylinder block 62 with four cylinder bores 65 formed side by side along a single plane. The engine 12 is an inclined L4 (in-line four cylinder) type. The engine illustrated in FIG. 4, however, merely exemplifies one type of engine on which various aspects and features of the present invention can be used. Engines having a different number of cylinders, other cylinder arrangements, other cylinder orientations (e.g., upright cylinder banks, V-type, and W-type), and operating on other combustion principles (e.g., crankcase compression two-stroke, diesel, and rotary) are all practicable. Other variations or types of engines on which various aspects and features of the present inventions can be used are described in detail below.

With continued reference to FIG. 3, a piston 64 reciprocates in each of the cylinder bores 65 formed within the cylinder block 62. A cylinder head member 66 is affixed to the upper end of the cylinder block 62 to close respective upper ends of the cylinder bores 65. The cylinder head member 66, the cylinder bores 65 and the pistons 64 together define combustion chambers 68.

A lower cylinder block member or crankcase member 70 is affixed to the lower end of the cylinder block 62 to close the respective lower ends of the cylinder bores 65 and to define, in part, a crankshaft chamber. The crankshaft 56 is journaled between the cylinder block 62 and the lower cylinder block member 70. The crankshaft 56 is rotatably connected to the pistons 64 through connecting rods 74. Preferably, a crankshaft speed sensor 105 is disposed proximate the crankshaft to output a signal indicative of engine speed. In some configurations, the crankshaft speed sensor 105 is formed, at least in part, with a flywheel magneto. The speed sensor 105 also can output crankshaft position signals in some arrangements.

The cylinder block 62, the cylinder head member 66 and the crankcase member 70 together generally define the engine 12. The engine 12 preferably is made of an aluminum based alloy. In the illustrated embodiment, the engine 12 is oriented in the engine compartment to position the crankshaft 56 generally parallel to a central plane. Other orientations of the engine, of course, are also possible (e.g., with a transversely or vertically oriented crankshaft).

The engine 12 preferably includes an air induction system to introduce air to the combustion chambers 68. In the illustrated embodiment, the air induction system includes four air intake ports 78 defined within the cylinder head member 66, which ports 78 generally correspond to and communicate with the four combustion chambers 68. Other numbers of ports can be used depending upon the application. Intake valves 80 are provided to open and close the intake ports 78 such that flow through the ports 78 can be controlled.

The air induction system also includes an air intake box (not shown) for smoothing intake airflow and acting as an intake silencer. The intake box is generally rectangular and defines a plenum chamber (not shown). Other shapes of the intake box of course are possible, but the plenum chamber preferably is as large as possible while still allowing for positioning within the space provided in the engine compartment.

The illustrated air induction system preferably also includes a bypass passage 83 and an idle speed control device (ISC) 94 including an actuator 85 that can be controlled by an Electronic Control Unit (ECU) 92. In one advantageous arrangement, the ECU 92 is a microcomputer that includes a micro-controller having a CPU, a timer, RAM, and ROM. Of course, other suitable configurations of the ECU also can be used. Preferably, the ECU 92 is configured with or capable of accessing various maps to control engine operation in a suitable manner.

In general, the ISC device 94 comprises the air passage 83 that bypasses a throttle valve 90. Air flow through the air passage 83 of the ISC device 94 preferably is controlled by the actuator 85 that moves a suitable valve, such as a needle valve or the like. In this manner, the air flow amount can be controlled and engine output can be changed.

A throttle lever position sensor 88 preferably is arranged proximate the throttle lever 34 in the illustrated arrangement. The sensor 88 preferably generates a signal that is representative of absolute throttle lever position. The signal from the throttle lever position sensor 88 preferably corresponds generally to an operator's torque request, as may be indicated by the degree of throttle lever position.

A manifold pressure sensor 93 and a manifold temperature sensor 95 can also be provided to determine engine load. The signal from the throttle lever position sensor 88 (and/or manifold pressure sensor 93) can be sent to the ECU 92 via a throttle position data line. The signal can be used to control various aspects of engine operation, such as, for example, but without limitation, fuel injection amount, fuel injection timing, ignition timing, ISC valve positioning and the like.

The engine 12 also includes a fuel injection system which preferably includes four fuel injectors 96, each having an injection nozzle exposed to a respective intake port 78 so that injected fuel is directed toward the respective combustion chamber 68. Thus, in the illustrated arrangement, the engine 12 features port fuel injection. It is anticipated that various features, aspects and advantages of the present inventions also can be used with direct or other types of indirect fuel injection systems.

With reference again to FIG. 3, fuel is drawn from the fuel tank 40 through a fuel filter 98 by a fuel pump 100, which is controlled by the ECU 92. The fuel is delivered to the fuel injectors 96 through a fuel delivery conduit. The pressure of the fuel delivered to the fuel in sectors 96 is controlled by a pressure control valve 104. The pressure control valve 104 is controlled by a signal from the ECU 92.

In operation, a predetermined amount of fuel is sprayed into the intake ports 78 via the injection nozzles of the fuel injectors 96. The timing and duration of the fuel injection is dictated by the ECU 92 based upon any desired control strategy. In one presently preferred configuration, the amount of fuel injected is determined based, at least in part, upon the sensed throttle lever position. The fuel charge delivered by the fuel injectors 96 then enters the combustion chambers 68 with an air charge when the intake valves 80 open the intake ports 78.

The engine 12 further includes an ignition system. In the illustrated arrangement, four spark plugs 106 are fixed on the cylinder head member 66. The electrodes of the spark plugs 106 are exposed within the respective combustion chambers 68. The spark plugs 106 ignite an air/fuel charge just prior to, or during, each power stroke. At least one ignition coil 108 delivers a high voltage to each spark plug 106. The ignition coil is preferably under the control of the ECU 92 to ignite the air/fuel charge in the combustion chambers 68.

The engine 12 further includes an exhaust system to discharge burnt charges, i.e., exhaust gases, from the combustion chambers 68. In the illustrated arrangement, the exhaust system includes four exhaust ports 110 that generally correspond to, and communicate with, the combustion chambers 68. The exhaust ports 110 preferably are defined in the cylinder head member 66. Exhaust valves 112 preferably are provided to selectively open and close the exhaust ports 110.

A combustion condition or oxygen sensor 107 preferably is provided to detect the in-cylinder combustion conditions by sensing the residual amount of oxygen in the combustion products at a point in time close to when the exhaust port is opened. The signal from the oxygen sensor 107 preferably is delivered to the ECU 92. The oxygen sensor 107 can be disposed within the exhaust system at any suitable location. In the illustrated arrangement, the oxygen sensor 107 is disposed proximate the exhaust port 110 of a single cylinder. Of course, in some arrangements, the oxygen sensor can be positioned in a location further downstream; however, it is believed that more accurate readings result from positioning the oxygen sensor upstream of a merge location that combines the flow of several cylinders.

The engine 12 further includes a cooling system configured to circulate coolant into thermal communication with at least one component within the watercraft 10. The cooling system can be an open-loop type of cooling system that circulates water drawn from the body of water in which the watercraft 10 is operating through thermal communication with heat generating components of the watercraft 10 and the engine 12. Other types of cooling systems can be used in some applications. For instance, in some applications, a closed-loop type liquid cooling system can be used to cool lubricant and other components.

An engine coolant temperature sensor 109 preferably is positioned to sense the temperature of the coolant circulating through the engine. Of course, the sensor 109 could be used to detect the temperature in other regions of the cooling system; however, by sensing the temperature proximate the cylinders of the engine, the temperature of the combustion chamber and the closely positioned portions of the induction system is more accurately reflected.

The engine 12 preferably includes a lubrication system that delivers lubricant oil to engine portions for inhibiting frictional wear of such portions. In the illustrated embodiment of FIG. 4, a closed-loop type lubrication system is employed. An oil delivery pump is provided within a circulation loop to deliver the oil through an oil filter (not shown) to the engine portions that are to be lubricated, for example, but without limitation, the pistons 64 and the crankshaft bearings (not shown).

In order to determine appropriate engine operation control scenarios, the ECU 92 preferably uses these control maps and/or indices stored within the ECU 92 in combination with data collected from various input sensors. The ECU's various input sensors can include, but are not limited to, the throttle lever position sensor 88, the manifold pressure sensor 93, the intake temperature sensor 95, the engine coolant temperature sensor 109, the oxygen ($O_2$) sensor 107, and a crankshaft speed sensor 105. A steering torque sensor is also provided and is used for engine control in accordance with suitable control routines, which are discussed below. It should be noted that the above-identified sensors merely correspond to some of the sensors that can be used for engine control and it is, of course, practicable to provide other sensors, such as an intake air pressure sensor, an intake air temperature sensor, a knock sensor, a neutral sensor, a watercraft pitch sensor, a shift position sensor and an atmospheric temperature sensor. The selected sensors can be provided for sensing engine running conditions, ambient conditions or other conditions of the engine 12 or associated watercraft 10.

During engine operation, ambient air enters the internal cavity defined in the hull 14. The air is then introduced into the plenum chamber defined by the intake box and drawn towards the throttle valve 90. The majority of the air in the plenum chamber is supplied to the combustion chambers 68. The throttle valve 90 regulates an amount of the air permitted to pass to the combustion chambers 68. The opening angle of the throttle valve 90, and thus, the airflow across the throttle valve 90, can be controlled by the ECU 92 according to various engine parameters and the torque request signal received from the throttle lever position sensor 88. The air flows into the combustion chambers 68 when the intake valves 80 open. At the same time, the fuel injectors 96 spray fuel into the intake ports 78 under the control of ECU. Air/fuel charges are thus formed and delivered to the combustion chambers 68.

The air/fuel charges are fired by the spark plugs 106 throughout the ignition coil 108 under the control of the ECU 92. The burnt charges, i.e., exhaust gases, are discharged to the body of water surrounding the watercraft 10 through the exhaust system.

The combustion of the air/fuel charges causes the pistons 64 to reciprocate and thus causes the crankshaft 56 to rotate. The crankshaft 56 drives the impeller shaft 54 and the impeller rotates in the hull tunnel 48. Water is thus drawn into the jet pump unit 46 through the inlet port 50 and then is discharged rearward through the discharge nozzle 57.

Figure 4:
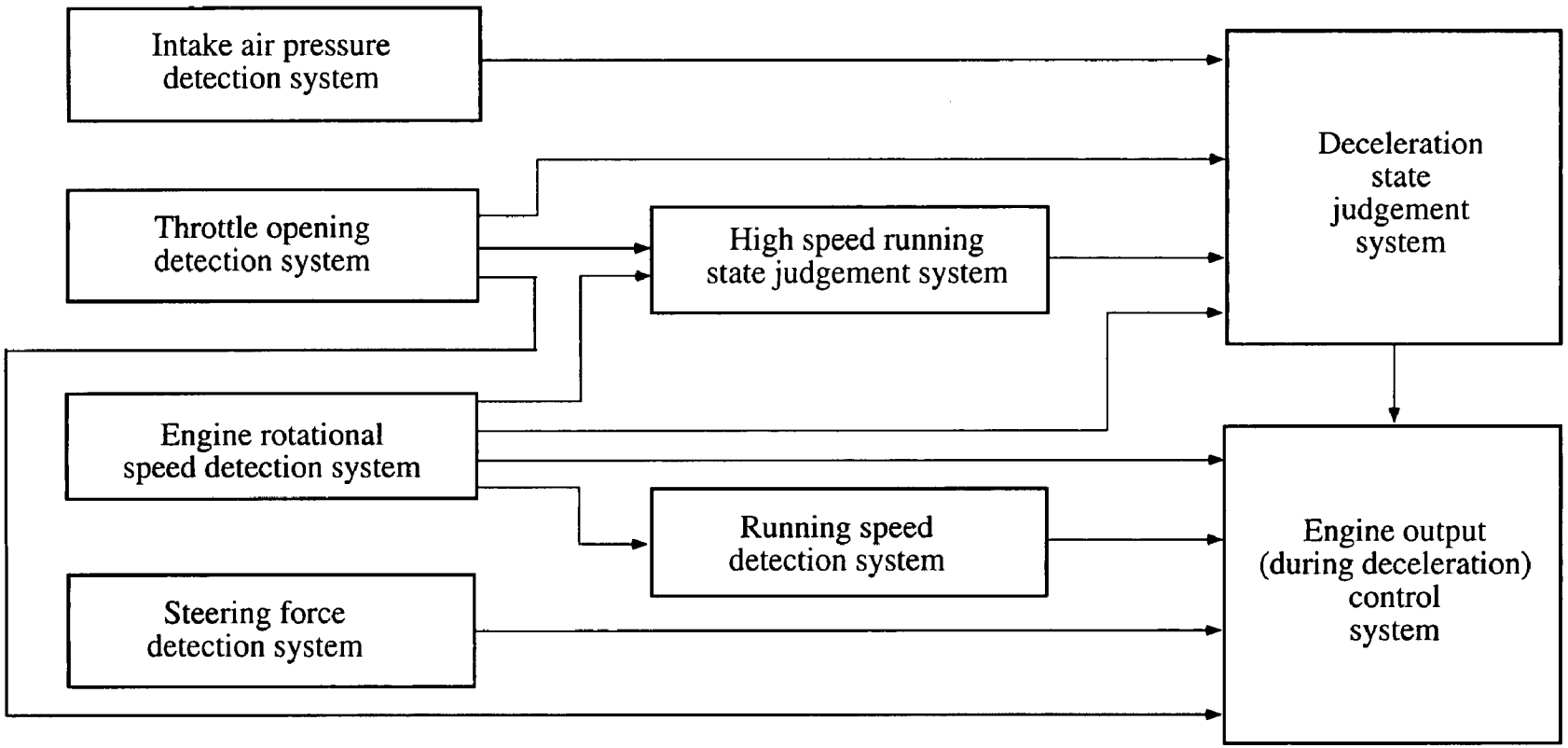
FIG. 4 is a block diagram illustrating an engine management system that uses various input parameters to provide a comfortable watercraft operational environment.

With reference now to FIG. 4, a block diagram illustrates various input systems, various determination systems, and an engine output control system of an engine management system. An intake air pressure detection system uses the intake manifold pressure sensor 93 to detect the pressure inside the intake manifold, which can be used to calculate an engine load value. A throttle lever opening detection system uses the throttle lever position sensor 88 to detect the actual position of the throttle lever 34, which is indicative of the operator's torque request. An engine speed detection system uses the crankshaft speed sensor 105 to detect the actual speed and position of the crankshaft 56. A steering force detection system uses the steering torque sensor 36 to determine the amount of force the operator is exerting on the handlebars 32.

The various input systems are used to determine at which speed the engine and the watercraft are operating. Additionally at least one of the input systems can be configured to determine if the watercraft is in a deceleration mode. The engine output control system can be configured to raise the power output of the engine beyond that which is indicated by the throttle level position sensor 88 during deceleration and turning, so as to provide the operator with a comfortable riding environment.

Figure 5:
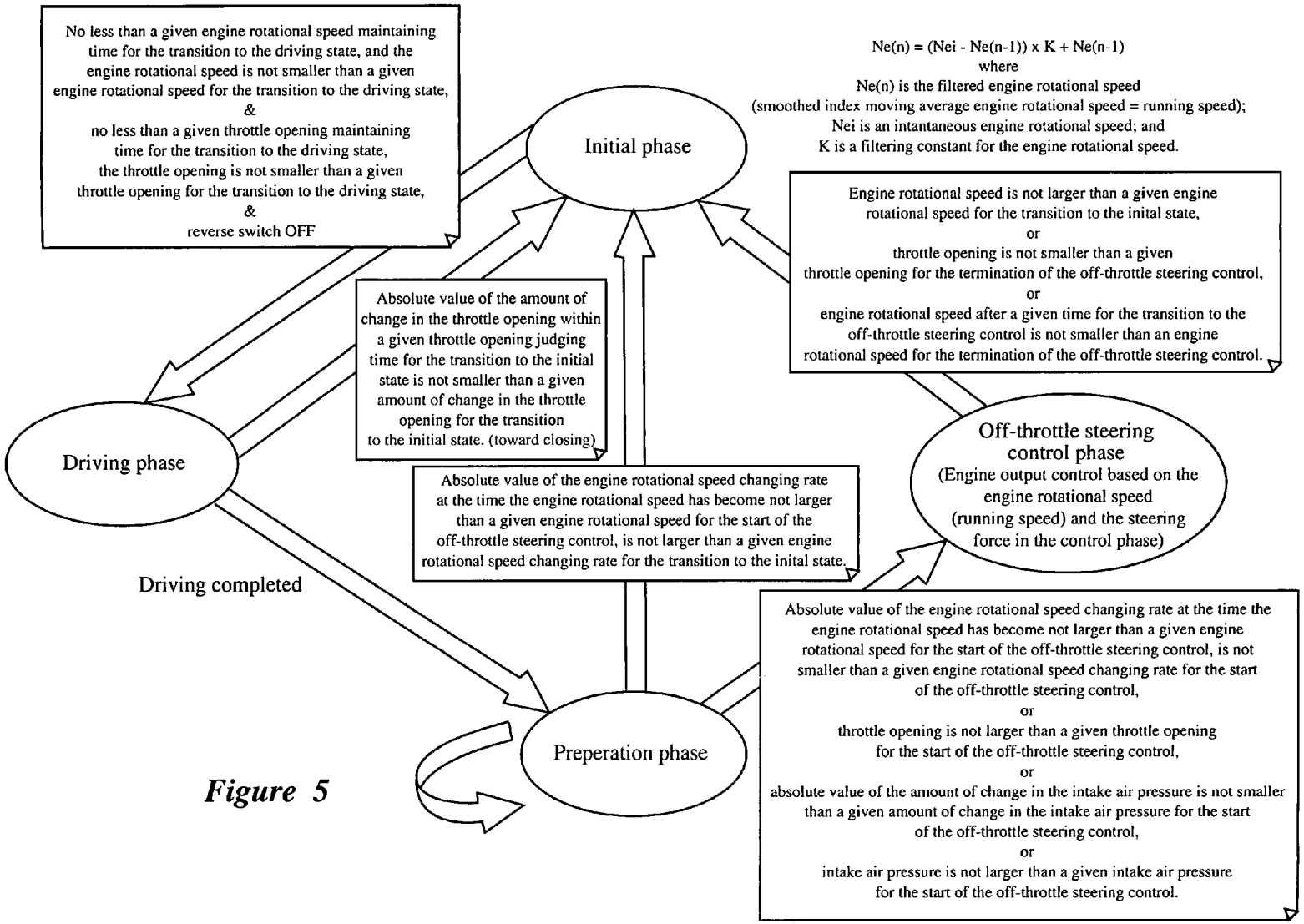
FIG. 5 is an engine management function diagram that shows four phases of engine operation. The engine management function diagram also illustrates how engine operation changes from one phase to another.

FIG. 5 illustrates a flow diagram of various phases of one preferred embodiment of a steering system. The illustrated embodiment uses the ISC valve to control engine speed during off throttle steering and describes how the system moves from one phase to another. Detecting an accurate watercraft speed can be challenging because of the varying currents and fluid motion of the water in which the watercraft operates. Due to the challenging nature of detecting accurate watercraft speed, the engine speed can be used to calculate a representation of watercraft speed. The following formula can be used by the ECU 92 to calculate or estimate the watercraft speed according to an instantaneous engine speed.

$$N_{(n)}=(Nei-N_{(n-1)})\times K+N_{(n-1)}$$

In this above equation, N is a filtered engine rotational speed at time (n) that is indicative of the watercraft speed, Nei is the instantaneous engine speed, and K is a filtering constant for the instantaneous engine speed. In this embodiment, $N_{(n-1)}$ represents a previously calculated filtered engine speed, i.e., at time (n-1). The constant K can be determined by routine experimentation such that the resulting filtered engine speed can be used as to estimate a watercraft or "running" speed. As such, this equation provides a lag in which the filtered engine speed N changes more slowly than the instantaneous engine speed Nei, similar to the way a watercraft speed changes more slowly and its engine speed. Thus the filtered engine speed N is more proportional to the watercraft speed than the instantaneous engine speed Nei.

Other equations that can be used by the ECU to determine transitions between the watercraft operational phases are explained below. These equations are used throughout the control routine diagrams and are meant merely to simplify the description of the following flow diagrams and control routines. The following are variables that can be used in the equations set forth below:

N=Filtered engine speed.

$N_D$=Predetermined engine speed for the transition to the Driving Phase.

$|\dot{N}|$=Absolute value of the engine speed changing rate.

$N_N$=Predetermined value of the engine speed for the transition to the Initial Phase.

$\dot{N}_N$=Predetermined engine speed changing rate for the transition to the Initial Phase.

$N_{S1}$=Predetermined engine speed for the start of Off-Throttle Steering control.

$\dot{N}_{S1}$=Predetermined engine speed changing rate for the start of Off-Throttle Steering control.

$N_{S0}$=Predetermined engine speed for the termination of Off-Throttle Steering control.

$T_h$=Throttle opening.

$T_{hD}$=Predetermined throttle opening for the transition to the Driving Phase.

$T_{hN}$=Predetermined throttle opening for the transition to the Initial Phase.

$|\dot{T}_{hN}|$=Absolute value of the rate of change in the throttle opening toward a closed position for the transition to the Initial Phase.

$T_{hS1}$=Predetermined throttle opening for the start of Off-Throttle Steering control.

$T_{hS0}$=Predetermined throttle opening for the termination of Off-Throttle Steering control.

$I_P$=Intake air pressure.

$|\dot{I}_P|$=Absolute value of the rate of change of the intake air pressure.

$I_{PS1}$=Predetermined intake air pressure for the start of Off-Throttle Steering control.

$\dot{I}_{PS1}$=Predetermined rate of change in the intake air pressure for the start of Off-Throttle Steering control.

$t_D$=Predetermined time for transition to the Driving Phase.

$t_{S1}$=Predetermined amount of time for the transition to the Off-Throttle Steering control.

The flow diagram of FIG. 5 illustrates four phases of the watercraft and corresponding off-throttle steering control. The watercraft control starts in an initial phase. The initial phase can be defined as a state where the watercraft stays substantially stationary for a range of engine speeds ranging from idle to a predetermined speed. The watercraft begins to move after the predetermined speed is exceeded.

From the initial phase, the watercraft can transition to a driving phase. For example, the watercraft can be deemed to have entered the driving phase if at least one of the conditions is satisfied: (1) a filtered engine speed N is greater than or equal to a predetermined transition engine speed $N_D$ for a given time $t_D$, as described by the equation: ($N \geqq N_D$) for a given time $t_D$, (2) a throttle opening $T_h$ is greater than or equal to a predetermined throttle opening $T_{hD}$ for the driving phase for a given time $t_D$, as illustrated by the equation: ($T_h \geqq T_{hD}$), and (3) the reverse switch is open indicating that the watercraft is not in a reverse mode. Any of these conditions can be used to determine that the watercraft is moving. However, other conditions can also be used.

According to the control flow diagram illustrated in FIG. 5, the watercraft can either go back to the initial phase or go to a preparation phase. With respect to returning to the initial phase, the watercraft can be deemed as such if the absolute value of the rate of change of the throttle angle toward the closed position is greater than or equal to a predetermined throttle angle, $|\dot{T}_{hN}| \geqq T_{hN}$. Such a condition would indicate that the operator has released the throttle lever sufficiently quickly before the watercraft has reached an elevated speed that that off throttle steering control will not be desired, and thus, the process can return to the initial phase.

The transition from the driving phase to the preparation phase occurs naturally as the operator continues to ride the watercraft at an elevated engine speed and throttle opening. In other words, the driving phase is the beginning of the preparation phase. The driving phase and the preparation phase can be considered a single phase after the engine speed has reached the predetermined engine speed.

During typical operation the watercraft 10 remains in the preparation phase. Where the watercraft is operated at a planning speed, the smoothed engine speed N will normally remain above a predetermined speed for entering the off throttle steering control phase $N_{S1}$, i.e., $N>N_{S1}$.

During the preparation phase, the watercraft 10 can transition back to the initial phase or to the off-throttle steering control phase. The watercraft can move from the preparation phase back to the initial phase if, for example, the absolute value of the engine rotational speed changing rate is less than or equal to a predetermined engine speed changing rate when the instantaneous engine speed Nei falls to a value below a threshold for triggering the off throttle control phase, as illustrated by the equation $|\dot{N}| \leqq \dot{N}_N$ and $Nei \leqq N_{S1}$. For example, if the engine speed slows gradually, the off throttle steering control is not desired.

From the preparation phase, the watercraft can also move to the off-throttle steering control phase. For example, as noted above, during operation in the preparation phase, the filtered engine speed N relacts a value that corresponds to an elevated watercraft speed, e.g., a planning condition for a personal watercraft. If the instantaneous engine speed Nei falls to a value below a threshold value for triggering off throttle steering control, the watercraft can be deemed as transitioned to the off-throttle steering control phase if at least one of, for example, four conditions are met. These conditions can include: (1) when an absolute value of engine speed rate of change is greater than or equal to a predetermined engine speed rate change, e.g. $|\dot{N}| \geqq \dot{N}_{S1}$, (2) the throttle angle opening has fallen to an opening that is less than or equal to a predetermined throttle angle opening, $T_h \leqq T_{hS1}$, (3) the absolute value of the intake air pressure rate of change is greater than or equal to a predetermined intake air pressure rate of change, $|\dot{I}_P| \geqq \dot{I}_{PS1}$, or (4) the intake air pressure is less than or equal to a predetermined intake air pressure $I_P \leqq I_{PS1}$. These conditions can be used to determine that the operator's torque request drops suddenly or quickly, and thus, off throttle steering control is likely to be desirable. However, other conditions can also be used.

The watercraft can also move to the initial phase from the off-throttle steering control phase when it is determined that off throttle steering control is not desired. For example, watercraft can also move to the initial phase from the off-throttle steering control phase when at least one of the following three conditions are me: (1) the filtered engine speed is less than or equal to a predetermined engine speed, $N \leqq N_N$, e.g. indicating that the watercraft has slowed sufficiently that off throttle steering control is no longer desirable, (2) when the throttle angle is greater than or equal to a predetermined throttle angle $T_h \geqq T_{hS0}$, or (3) after a predetermined amount of time, the engine speed is greater than or equal to a predetermined engine speed, $N \geqq N_{S0}$, the latter two conditions indicating, for example, that the operator has decided to request a sufficient amount of power output from the engine that off throttle steering control is not desired. However, other conditions can also be used.

During the off-throttle steering phase, the engine speed is manipulated to provide a natural feeling of off-throttle control. In some embodiments, this manipulation can be accomplished through control of the idle control valve. The idle control valve can allow more or less air to bypass the throttle valve in order to increase or decrease engine speed to provide off-throttle steering control and according to an operator's torque request, represented by the position of the throttle lever 34.

Figure 6:
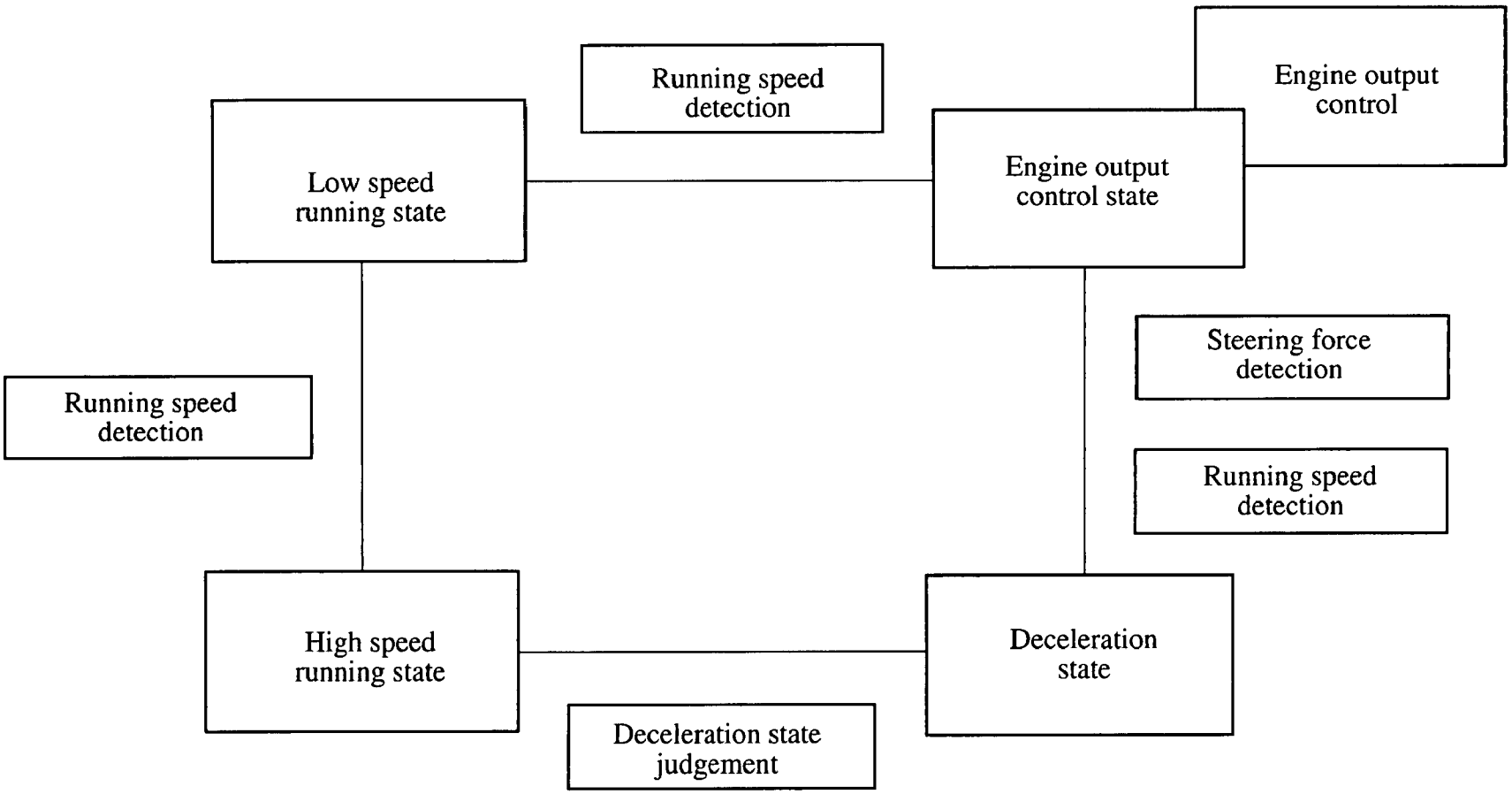
FIG. 6 is a block diagram illustrating various engine operational states and the parameters that define each engine operational state.

With reference to FIG. 6, a block diagram is shown that illustrates the control logic of FIG. 5 corresponding to the four operating phases or running states of the watercraft. The diagram of FIG. 6 shows how each state of watercraft operation is related to the other. For example, the engine output control state is active during an off-throttle steering control. The engine output control state is determined through speed detection and steering force detection to control the engine during an off throttle steering situation.

The watercraft can operate in varying states including the low speed state, the high speed state, and a deceleration state. The watercraft can transition from the high speed running state to a low speed running state or a deceleration state through various detection systems. For example, the watercraft can transition from a high speed running state to a low speed running state by detecting the engine speed. The watercraft can also transition from a high speed running state to a deceleration state by determining the amount of deceleration detection. When the watercraft is decelerating from a high speed running state, the deceleration rate and steering torque value are established and the engine output control state controls the engine to provide enhanced comfort for the operator.

With reference to FIGS. 7 through 10, an overall control arrangement is shown that is arranged and configured in accordance with an embodiment incorporating at least one of the present inventions. The complete control routine offers a further explanation of the control diagram of FIG. 5. Sections of the overall control routine are illustrated in FIG. 7 through 10. Each section illustrated in a separate diagram is related to the other sections by capital letters ranging from A through F.

Figure 7:
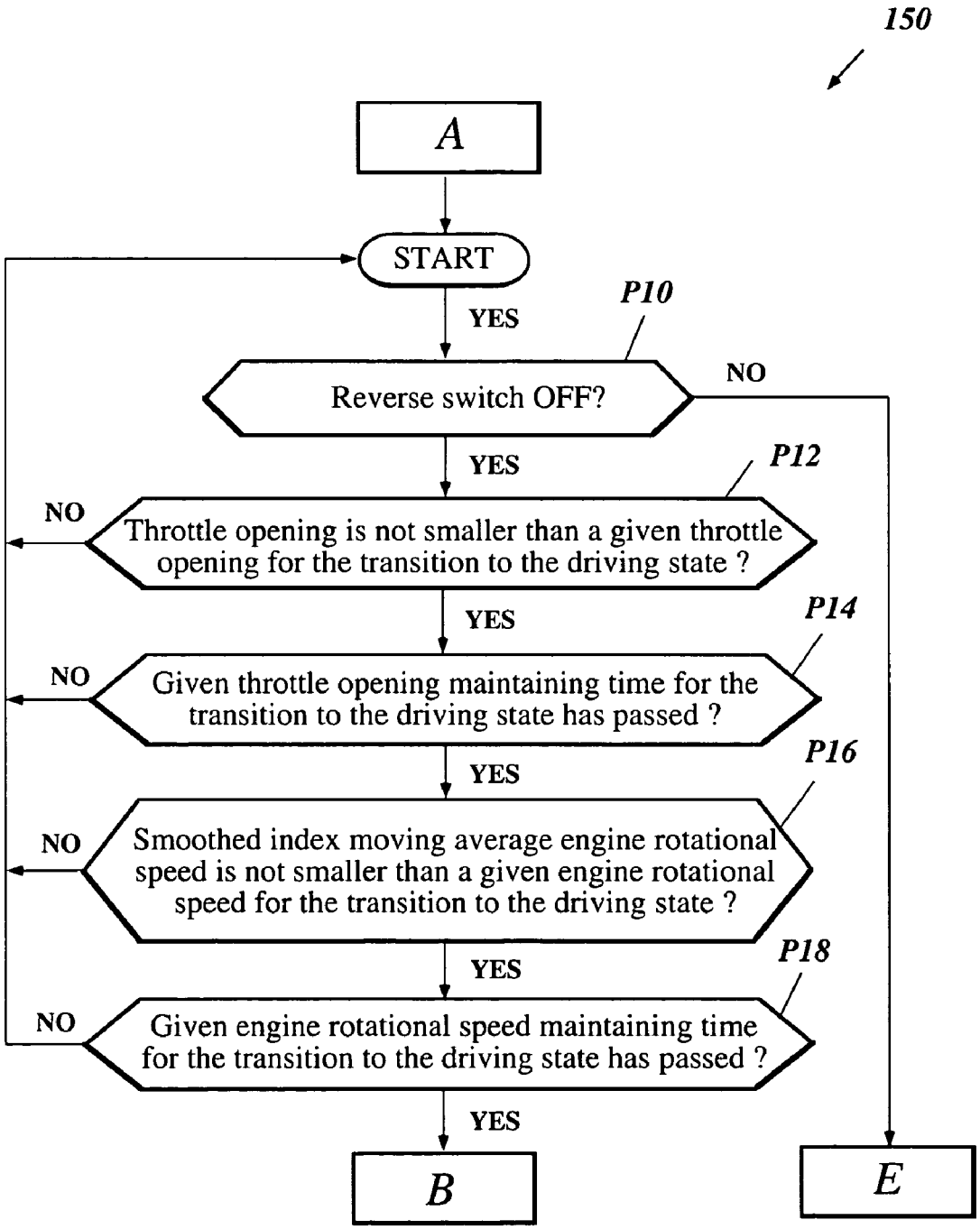
FIG. 7 is a block diagram showing a control routine that can be used with the control system of FIG. 3.

A first control routine section 150 begins in FIG. 7 and moves to a first decision block P10 where it is determined if the reverse switch is off. When the reverse switch is not off, it is indicative of the watercraft being operated in the reverse mode. If in decision block P10 the reverse switch is not off, the control routine 150 proceeds to a control routine section 156 (FIG. 10) where it ends and returns to the control routine section 150. If, however, in the decision block P10 it is determined that the reverse switch is off, the control routine proceeds to a decision block P12.

In decision block P12, it is determined if the throttle opening is not smaller than a given throttle opening for the transition of the driving state, $T_h \geqq T_{hD}$. If in decision block P12 it is determined that the throttle opening is smaller than a given throttle opening from the transition to the driving state, the control routine 150 returns to start. If, however, in operation block P12 it is determined that the throttle valve opening is not smaller than a given throttle opening from the transition to the driving state, the control routine 150 moves to a decision block P14.

In decision block P14, it is determined if a predetermined throttle opening time for the transition to the driving state from the initial state has passed. If, in decision block P14, it is determined that the predetermined throttle opening time for the transition to the driving state has not passed, the control routine 150 returns. If, however, in decision block P14 it is determined that the throttle opening time has passed, the control routine 150 proceeds to a decision block P16.

In decision block P16, it is determined if a smoothed index moving average engine rotational speed is not smaller than a predetermined engine rotation speed for the transition to the driving state, $N \geqq N_D$. The smoothed index moving average can be calculated in any known manner for smoothed or moving averages, such as those commonly used in statistical analysis of economic conditions. In some embodiments, the smoothed index moving average can be calculated using the formula disclosed above using engine speed data. If in decision block P16 it is determined that the index moving average engine rotation speed is not smaller than a predetermined engine rotation speed for the transition to the driving state, the control routine 150 returns. If, however, in decision block P16 it is determined that the smoothed index moving average engine speed is not smaller than a predetermined engine rotation speed for the transition to the driving state (e.g., the watercraft speed is elevated), the control routine 150 proceeds to a decision block P18.

In decision block P18, it is determined if a predetermined engine rotation speed has been maintained for a predetermined amount of time for the transition to the driving state. If in decision block P18, it is determined that a predetermined engine rotation speed has not been maintained for a predetermined amount of time, the control routine 150 returns. If however, in decision block P18 it is determined that the predetermined engine rotation speed has been maintained for the predetermined amount of time, the control routine 150 proceeds to operation block P20. Operation block P20 is shown in a continuing control routine section 152 illustrated in FIG. 8.

Figure 8:
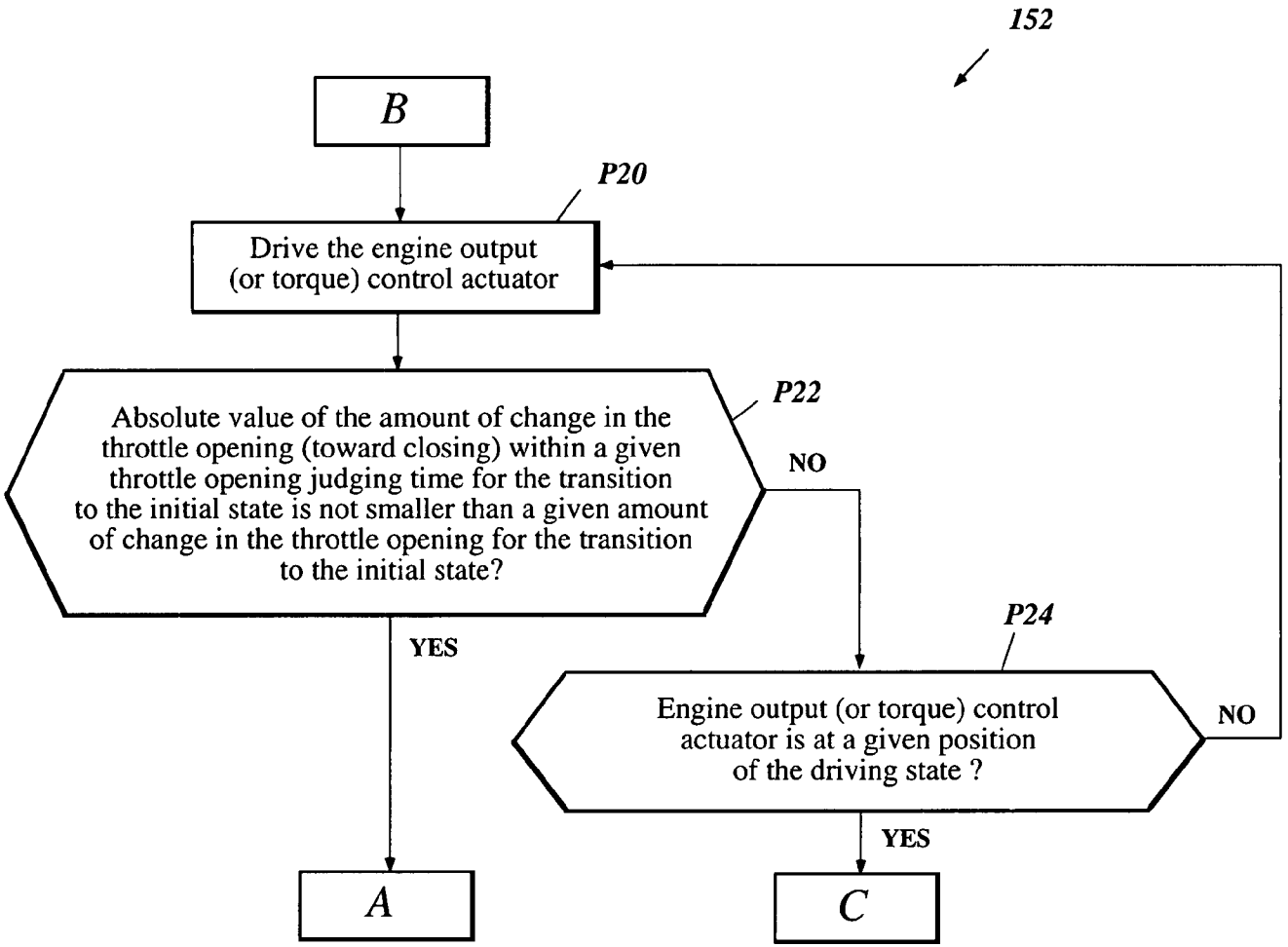
FIG. 8 is a block diagram showing another control routine that can be used with the control system of FIG. 3.

With reference to FIG. 8, the continuing control routine section 152 is shown and is arranged and configured in accordance An embodiment incorporating at least one of the inventions disclosed herein. The control routine 152 moves to a first operation block P20 where the idle control speed actuator is activated according to the driving state. The control routine 152 then moves to a decision block P22.

In decision block P22 it is determined if $|\dot{T}_{hN}| \geqq T_{hN}$ is true. If in decision block P22 it is determined that $|\dot{T}_{hN}| \geqq T_{hN}$ is true, the control routine 152 returns to the control routine section 150. If, however, in decision block P22 it is determined that $|\dot{T}_{hN}| \geqq T_{hN}$ is not true, the control routine moves to a decision block P24.

In decision block P24, it is determined if the idle speed control actuator is at a predetermined position according to the driving state. If in decision block P24 the control actuator of the idle control valve is not at the predetermined position, the control routine 152 returns to operation block P20. If, however, in decision block P24 it is determined that the idle speed control actuator is at the predetermined position, the control routine 152 proceeds to an operation block P30. Operation block P30 is shown in a continuing control routine section 154 illustrated in FIG. 9.

Figure 9:
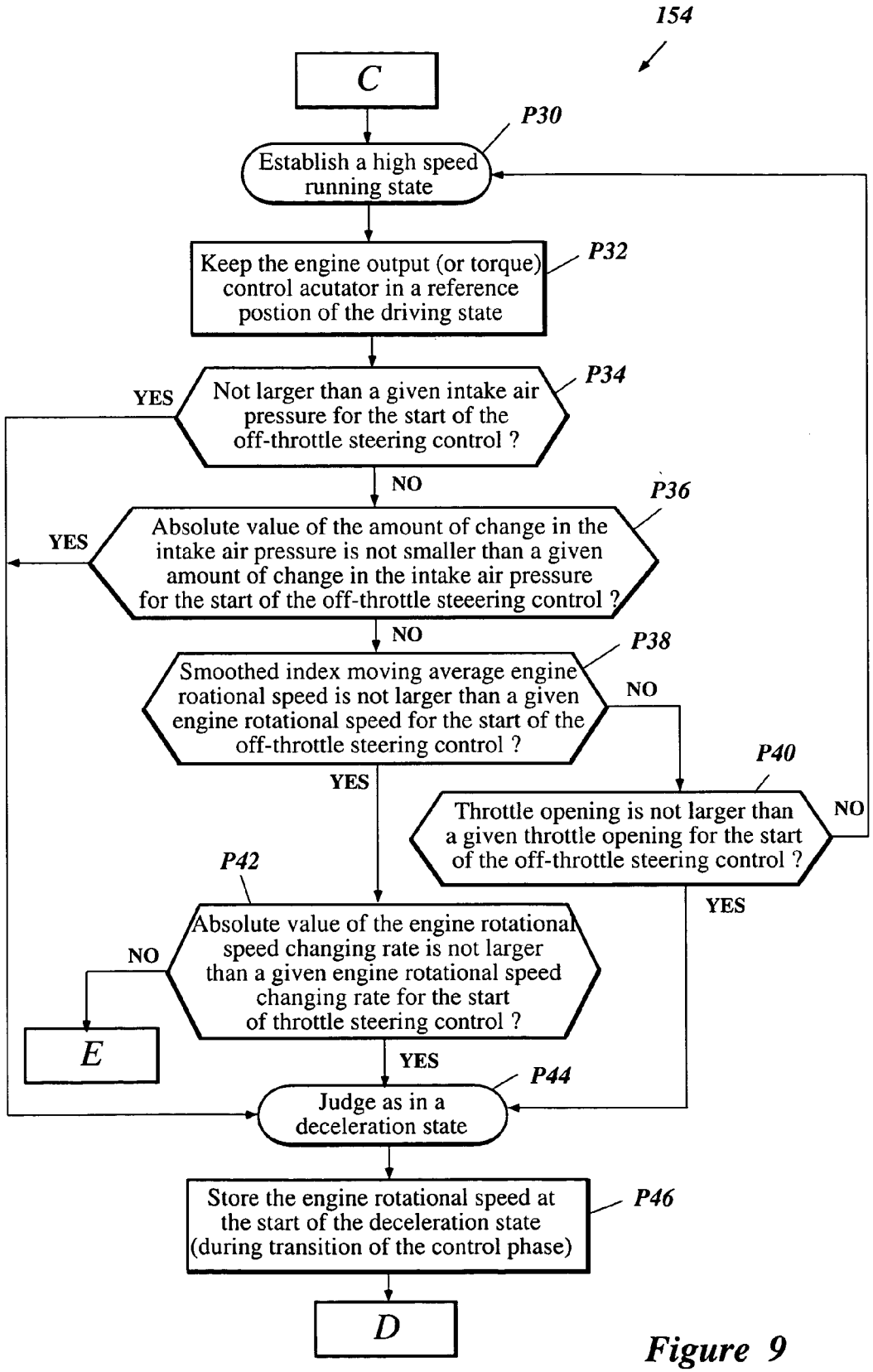
FIG. 9 is a block diagram showing another control routine that can be used with the control system of FIG. 3.

With reference to FIG. 9, the control routine section 154 is shown and is arranged and configured in accordance with an embodiment incorporating at least one of the present inventions. The control routine 154 moves to the first operation block P30 where a high speed running state is established. The control routine 154 then proceeds to an operation block P32.

In operation block P32, the idle speed control valve actuator is kept at a reference position corresponding to watercraft engine operation in the driving state. The control routine 154 then proceeds to a decision block P34.

In decision block P34, it is determined if the equation $I_P \leqq I_{PS1}$ is true. If in decision block P34 it is determined that $I_P \leqq I_{PS1}$ is true, the control routine 154 moves to an operation block P44, where it is determined that the watercraft is in a deceleration state. If, however, in decision block P34 it is determined that $I_P \leqq I_{PS1}$ is not true, the control routine moves to a decision block P36.

In decision block P36 it is determined if $|\dot{I}_P| \geqq \dot{I}_{PS1}$ is true, the control routine 154 moves to the operation block P44 where it is determined that the watercraft is in a deceleration state. If, however, in decision block P36 it is determined that $|I_P| \geqq I_{ps}$ is not true, the control routine 154 moves to a decision block P38.

In decision block P38 it is determined if $N \leqq N_N$ is true. If in decision block P38 it is determine that $N \leqq N_N$ is not true, the control routine 154 moves to a decision block P40 where it is determined if $Th \geqq T_{hS0}$ is true. If in decision block P40 it is determined that $Th \geqq T_{hS0}$ is not true, the control routine 154 returns to operation block P30. If, however, in decision block P40 it is determined that $Th \geqq T_{hS0}$ is true, the control routine 154 proceeds to the operation block P44.

If in decision block P38 it is determined that $N \leqq N_N$ is true, the control routine 154 moves to a decision block P42.

In decision block P42 it is determined if $|\dot{N}| \leqq \dot{N}_{S1}$ is true. In decision block P42 if it is determined that $|\dot{N}| \leqq \dot{N}_{S1}$ is not true, the control routine 154 moves to a control routine section 156 and ends. If, however, in decision block P42 it is determined that $|\dot{N}| \leqq \dot{N}_{S1}$ is true, the control routine 154 moves to the operation block P44 where it is determined that the watercraft is in deceleration state.

The control routine 154 then proceeds to an operation block P46 where the engine speed at the start of the deceleration state is stored. The control routine 154 then proceeds to an operation block P50. Operation block P50 is shown in the continuing control routine section 156 illustrated in FIG. 10.

Figure 10:
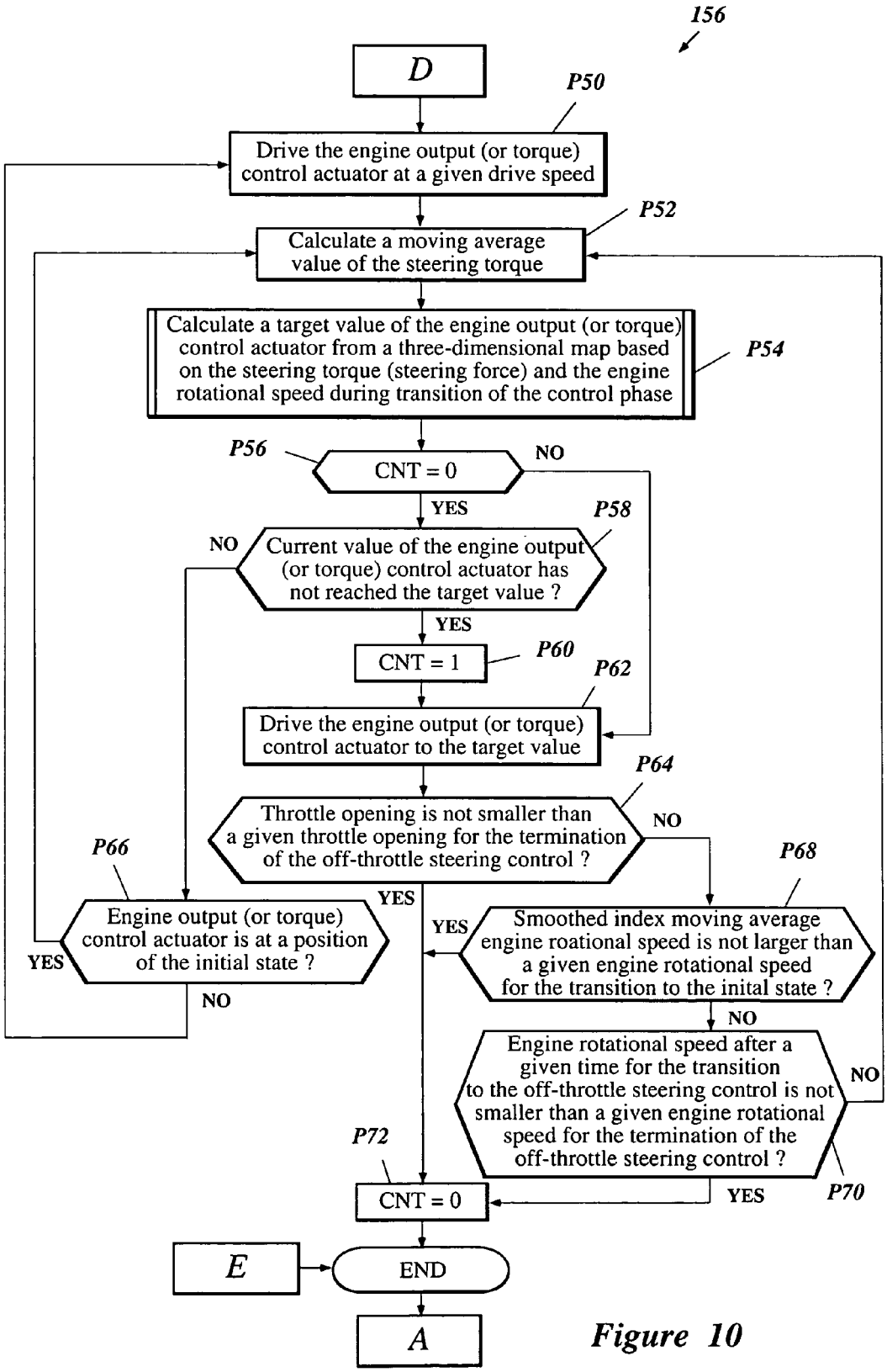
FIG. 10 is a block diagram showing another control routine that can be used with the control system of FIG. 3.

With reference to FIG. 10, the control routine section 156 is shown and is arranged and configured in accordance with an embodiment incorporating at least one of the present inventions. The control routine 156 moves to the first operation block P50 where the idle speed control valve actuator is driven according to a operator requested engine speed that corresponds to a predetermined watercraft speed. The control routine 156 then moves to operation block P52.

In operation block P52, an average value of the steering torque is calculated. The average of the steering torque can be calculated according to data received from the steering torque sensor 36. The control routine 156 then proceeds to an operation block P54.

In operation block P54, a target value of the idle speed control valve actuator is established based on a three-dimensional not shown in FIG. 11 which is described in more detail below. The control routine 156 then proceeds to a decision block P56.

In decision block P56, it is determined if a counter is equal to zero. If in decision block P56 the counter is not equal to zero, the control routine 156 proceeds to an operation block P62 where the idle speed control actuator is activated to a target value. If, however, in decision block P56 the counter is equal to zero, the control routine 156 proceeds to a decision block P58.

In decision block P58, it is determined if the idle speed control actuator has reached the target value. In decision block P58, if the actuator of the idle speed control valve has not reached the target value, the control routine 156 proceeds to a decision block P66. If, however, a decision block P58 it is determined that the current value of the idle speed actuator has reached the target value, the control routine 156 proceeds to an operation block P60 where a counter is set to 1. The control routine then proceeds to an operation block P62.

In operation block P62, the idle speed control valve actuator is moved to the target value of an engine speed according to a driver's request that corresponds to a watercraft speed. The control routine 156 then proceeds to the decision block P64.

In decision block P66, it is determined if the idle speed control valve actuator is at an initial state position. If in decision block P66 it is determined that the idle speed control valve actuator is at an initial state position, the control routine 156 returns to the operation block P52. If, however, in decision block P66 it is determined that the idle speed control valve actuator is not in the initial state position, the control routine returns to an operation block P50.

In decision block P64, it is determined if $T_h \geqq T_{hS0}$ is true. If in decision block P64 it is determined that $T_h \geqq T_{hS0}$ is true, the control routine 156 proceeds to an operation block P72. If however, in decision block P64 it is determined that $T_h \geqq T_{hS0}$ is not true, the control routine 156 proceeds to a decision block P68.

In decision block P68, it is determined if $N \leqq N_N$. If in decision block P68 it is determined that $N \leqq N_N$ is true, the control routine 156 proceeds to the operation block P72. If, however, in decision block P68 it is determined that $N \leqq N_N$ is not true, the control routine 156 proceeds to a decision block P70.

In decision block P70, it is determined if $N \geqq N_{S0}$ is true. If in decision block P70 it is determined that $N \geqq N_{S0}$ is not true, the control routine 156 returns to the operation block P52. If however in decision block P70 it is determined that $N \geqq N_{S0}$ is true, the control routine 4 proceeds to an operation block P72.

In operation block P72, the counter is set to zero. The control routine 156 then ends then returns to the decision block P10 in control routine section 150.

Figure 11:
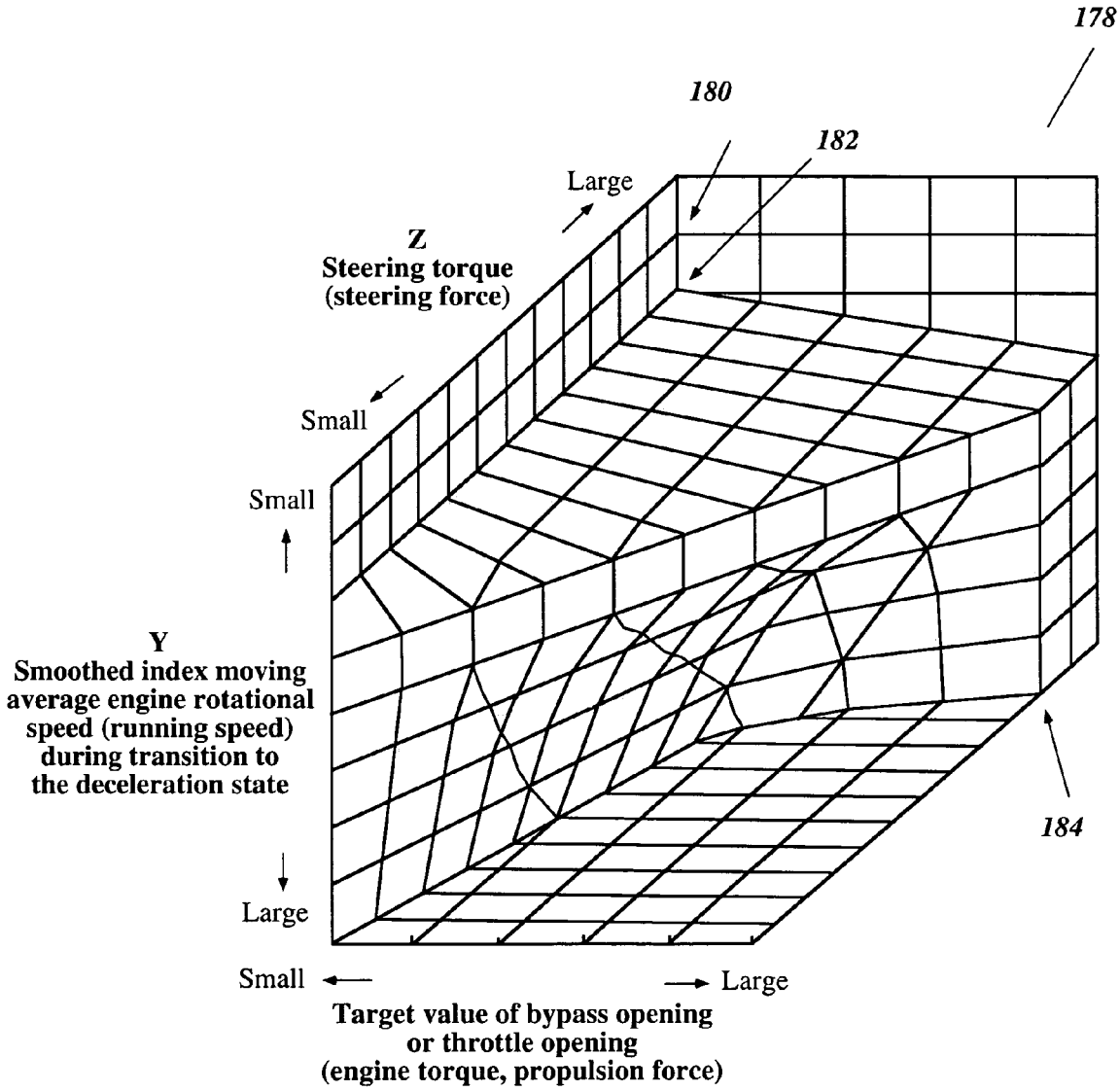
FIG. 11 is a diagram illustrating a three dimensional graph that determines the a bypass valve opening rate depending on a steering torque and an engine speed.

With reference to FIG. 11, an exemplary three dimensional map 178 illustrates a relationship between the position of the ISC actuator 85 or a motor control throttle opening and an engine speed during an off-throttle operation. The engine speed that corresponds to an off-throttle steering phase is determined and adjusted to provide comfortable watercraft operation.

Along the X-axis, a target value of the ISC actuator or the electronically controlled throttle valve is shown. The Y-axis illustrates the filtered engine rotational speed that is indicative of the watercraft speed. The Z-axis illustrates the steering torque that is measured by the torque sensor 36. Depending on the value of the steering torque and the filtered engine speed, the ISC actuator or throttle motor is activated to provide a comfortable off-throttle watercraft operation.

A reference point 180 illustrates an extreme condition where even though the steering torque is large, the ISC bypass passage opening or throttle valve opening is kept small. This small opening of the ISC bypass passage or throttle valve is provided because the filtered engine speed is low. This low filtered engine speed can represent a slow watercraft speed. A small filtered engine speed indicative of a small watercraft speed represents a watercraft environment that is comfortable to the operator. At the reference point 182 the filtered engine speed starts to increase and the ISC bypass valve or throttle opening increases quickly where the steering torque remains high.

A reference point 184 illustrates where the ISC bypass valve or throttle valve opening starts to decrease although a watercraft speed remains high. As the steering torque decreases, this high watercraft speed, small bypass or throttle opening situation also provides a comforting and controllable watercraft environment.

Figure 12:
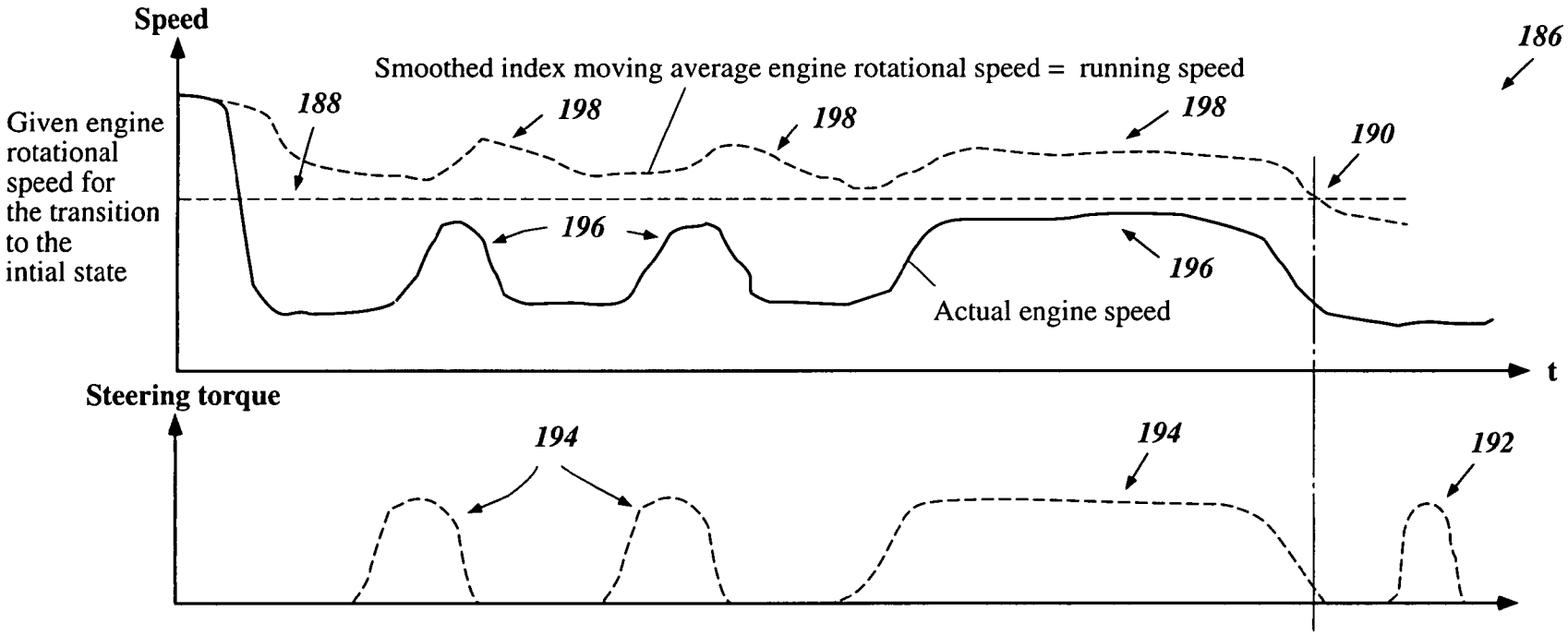
FIG. 12 is a diagram illustrating two graphs. A top graph illustrates engine speed with respect to time and bottom graph illustrates steering torque with respect to time.

A two dimensional graph 186 in FIG. 12 illustrates the relationship between the actual or instantaneous engine speed Nei, the filtered engine speed indicative of watercraft speed N, and the operator's steering torque with reference to time. A threshold line 188 determines when the off-throttle steering control is active. For example, when the watercraft speed is above the threshold line 188, the off-throttle steering control is active and increases engine output according conditions outlined in the previously explained control routines. If, however, the watercraft speed falls below the threshold line 188, for example at a reference point 190, the off-throttle steering control becomes inactive. When the watercraft speed is below the threshold line 188 and the steering torque increases, for example at a reference point 192, the off-throttle steering is inactive and does not increase the engine speed. A watercraft speed below the threshold line 188 is low enough to allow the operator to operate the watercraft 10 with comfort without off-throttle steering control.

During an operational period when the watercraft is decelerating into the initial state or phase, an increase in steering torque, for example at reference points 194, increases the actual engine speed (see reference points 196). Increasing the actual engine speed increases watercraft thrust which results is increased watercraft response. The increase in actual engine speed results in a proportional increase in watercraft speed, see reference point 198, which causes an increase in watercraft response.

Figure 13:
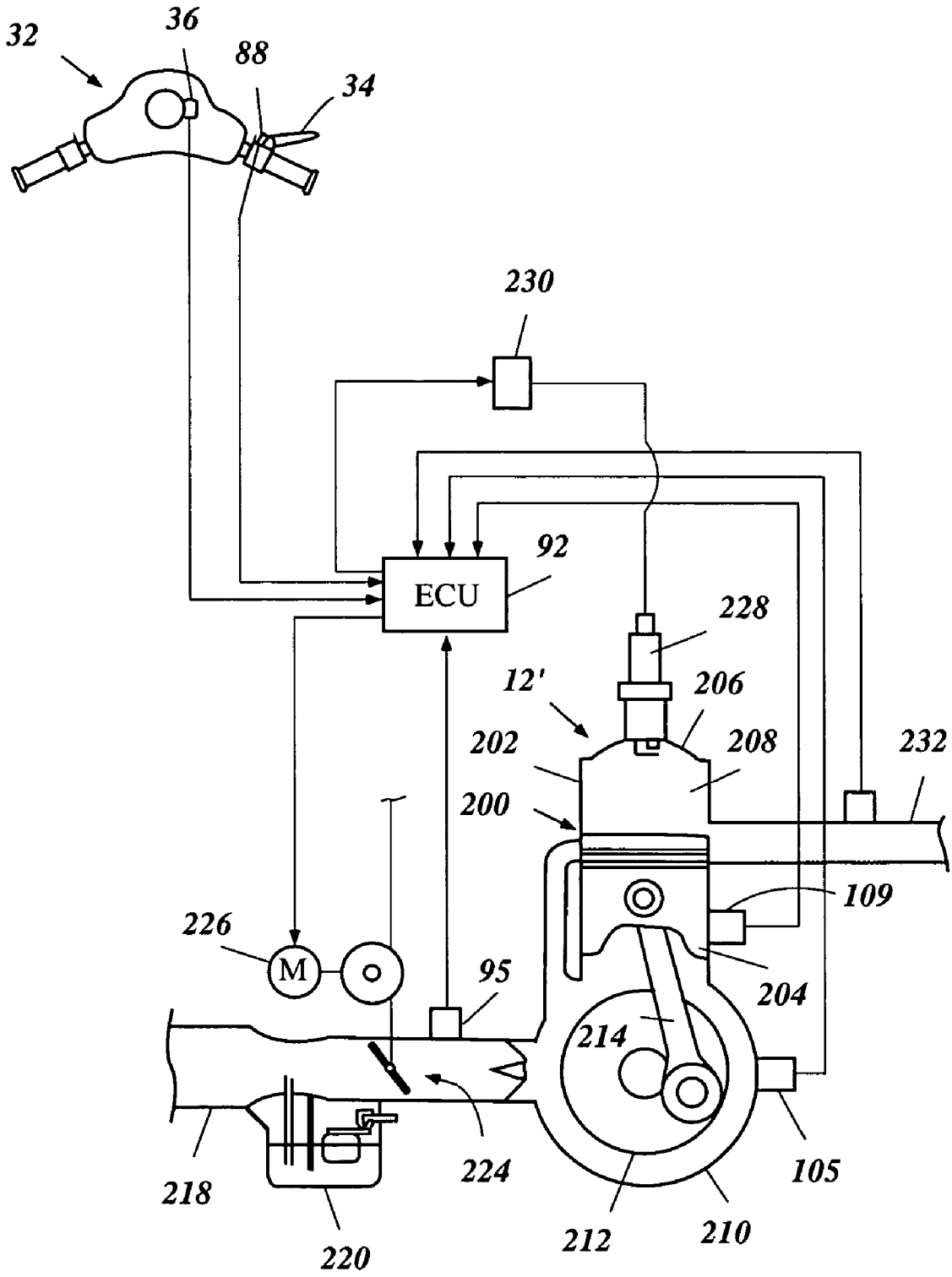
FIG. 13 is a schematic view showing another engine control system, including at least a portion of the engine in cross-section, an ECU, and a simplified fuel injection and simplified steering system.

A modification 12' of the engine 12 according to another embodiment is illustrated in FIG. 13 and operates on a two-stroke cycle combustion principal. In this embodiment, the engine includes a cylinder block 200 with at least one cylinder bore 202. The engine illustrated in FIG. 13, however, merely exemplifies one type of engine on which various aspects and features of the present inventions might be used. Engines having a different number of cylinders, other cylinder arrangements, other cylinder orientations (e.g., upright cylinder banks, V-type, and W-type), and operating on other combustion principles (e.g., four-stroke, diesel, and rotary) may all practicable. Other variations or types of engines on which various aspects and features of the present inventions can be used are described in detail below.

With continued reference to FIG. 13, a piston 204 reciprocates in the cylinder bore 202 formed within the cylinder block 200. A cylinder head member 206 is affixed to the upper end of the cylinder block 200 to close respective upper end of the cylinder bore 202. The cylinder head member 206, the cylinder bore 202 and the pistons 204 together define combustion chambers 208.

A lower cylinder block member or crankcase member 210 is affixed to the lower end of the cylinder block 200 to close the respective lower ends of the cylinder bore 202 and to define, in part, a crankshaft chamber. A crankshaft 212 is journaled between the cylinder block 200 and the cylinder block member 210. The crankshaft 212 is rotatably connected to the pistons 204 through connecting rods 214. Preferably, as with the four stroke embodiment illustrated in FIG. 3, the crankshaft speed sensor 105 is disposed proximate the crankshaft 212 to output the signal indicative of engine speed. In some configurations, the crankshaft speed sensor 105 is formed, at least in part, with a flywheel magneto. The speed sensor 105 also can output crankshaft position signals in some arrangements.

The cylinder block 200, the cylinder head member 206 and the crankcase member 210 together generally define the engine 12. The engine 12 preferably is made of an aluminum based alloy. In the illustrated embodiment, the engine 12 is oriented in the engine compartment to position the crankshaft 212 generally parallel to a central plane. Other orientations of the engine, of course, are also possible (e.g., with a transversely or vertically oriented crankshaft).

The engine 12 illustrated in FIG. 13 preferably includes an air induction system to introduce air to the combustion chambers 208. In the illustrated embodiment, the air induction system includes at least one air intake passage 218 that communicates with a carburetor 220. The air intake passage 218 and therefore the carburetor 220 communicate with the combustion chamber 208. It is anticipated that various features, aspects and advantages of the present inventions also can be used with direct or other types of direct or indirect fuel injection systems.

The air induction system also includes an air intake box (not shown) for smoothing intake airflow and acting as an intake silencer. The intake box is generally rectangular and defines a plenum chamber (not shown). Other shapes of the intake box of course are possible, but the plenum chamber preferably is as large as possible while still allowing for positioning within the space provided in the engine compartment.

The illustrated air induction system preferably also includes a throttle valve 224 that is activated by a throttle motor 226. The throttle motor 226 can be controlled by the ECU 92. As described above the ECU 92 is a microcomputer that includes a micro-controller having a CPU, a timer, RAM, and ROM. Of course, other suitable configurations of the ECU also can be used. Preferably, the ECU 92 is configured with or capable of accessing various maps to control engine operation in a suitable manner.

The throttle lever position sensor 88 preferably generates a signal that is representative of absolute throttle lever position. The signal from the throttle lever position sensor 88 preferably corresponds generally to an operators torque request, as may be indicated by the degree of throttle lever position. The ECU 92 receives the engine torque request signal and according to different modes of operation, including an off-throttle steering mode of operation, the ECU 92 can operate a throttle position using the throttle motor 226. In this manner, the air flow amount can be controlled and engine output can be changed.

The manifold temperature sensor 95 can be provided to assist in determining engine load. The signal from the throttle lever position sensor 88 (and the manifold temperature sensor 95) can be sent to the ECU 92 via a throttle position data line. The signal can be used to control various aspects of engine operation, such as, for example, but without limitation, ignition timing, throttle position, and the like.

The engine 12' illustrated in FIG. 13 further includes an ignition system. In the illustrated arrangement, at least one spark plug 228 is fixed on the cylinder head member 206. The electrodes of the spark plugs 228 are exposed within the respective combustion chambers 208. The spark plugs 228 ignite an air/fuel charge just prior to, or during, each power stroke. At least one ignition coil 230 delivers a high voltage to each spark plug 228. The ignition coil is preferably under the control of the ECU 92 to ignite the air/fuel charge in the combustion chambers 208.

The engine 12' illustrated in FIG. 13 further includes an exhaust system to discharge burnt charges, i.e., exhaust gases, from the combustion chamber 208. In the illustrated arrangement, the exhaust system includes at least one exhaust port 232 that generally corresponds to, and communicates with, the combustion chamber 208. The exhaust port 232 preferably is defined in the cylinder block 200.

The combustion condition or oxygen sensor 107 preferably is provided to detect the in-cylinder combustion conditions by sensing the residual amount of oxygen in the combustion products at a point in time close to when the exhaust port is opened. The signal from the oxygen sensor 107 preferably is delivered to the ECU 92. The oxygen sensor 107 can be disposed within the exhaust system at any suitable location. In the illustrated arrangement, the oxygen sensor 107 is disposed proximate the exhaust port 232 of the cylinder. Of course, in some arrangements, the oxygen sensor can be positioned in a location further downstream; however, it is believed that more accurate readings result from positioning the oxygen sensor upstream of a merge location that combines the flow of several cylinders.

The engine 12' illustrated in FIG. 13 further includes a cooling system configured to circulate coolant into thermal communication with at least one component within the watercraft 10. Preferably, the cooling system is an open-loop type of cooling system that circulates water drawn from the body of water in which the watercraft 10 is operating through thermal communication with heat generating components of the watercraft 10 and the engine 12. It is expect that other types of cooling systems can be used in some applications. For instance, in some applications, a closed-loop type liquid cooling system can be used to cool lubricant and other components.

The engine coolant temperature sensor 109 preferably is positioned to sense the temperature of the coolant circulating through the two stroke engine. Of course, the sensor 109 could be used to detect the temperature in other regions of the cooling system; however, by sensing the temperature proximate the cylinder of the engine, the temperature of the combustion chamber and the closely positioned portions of the induction system is more accurately reflected.

In order to determine appropriate engine operation control scenarios, the ECU 92 preferably uses these control maps and/or indices stored within the ECU 92 in combination with data collected from various input sensors. The ECU's various input sensors can include, but are not limited to, the throttle lever position sensor 88, the intake temperature sensor 95, the engine coolant temperature sensor 109, the oxygen ($O_2$) sensor 107, and a crankshaft speed sensor 105. The steering torque sensor 88 is also provided and is used for engine control in accordance with suitable control routines, which will be discussed below. It should be noted that the above-identified sensors merely correspond to some of the sensors that can be used for engine control and it is, of course, practicable to provide other sensors, such as a knock sensor, a neutral sensor, a watercraft pitch sensor, a shift position sensor and an atmospheric temperature sensor. The selected sensors can be provided for sensing engine running conditions, ambient conditions or other conditions of the engine 12' illustrated in FIG. 13 or associated watercraft 10.

Figure 14:
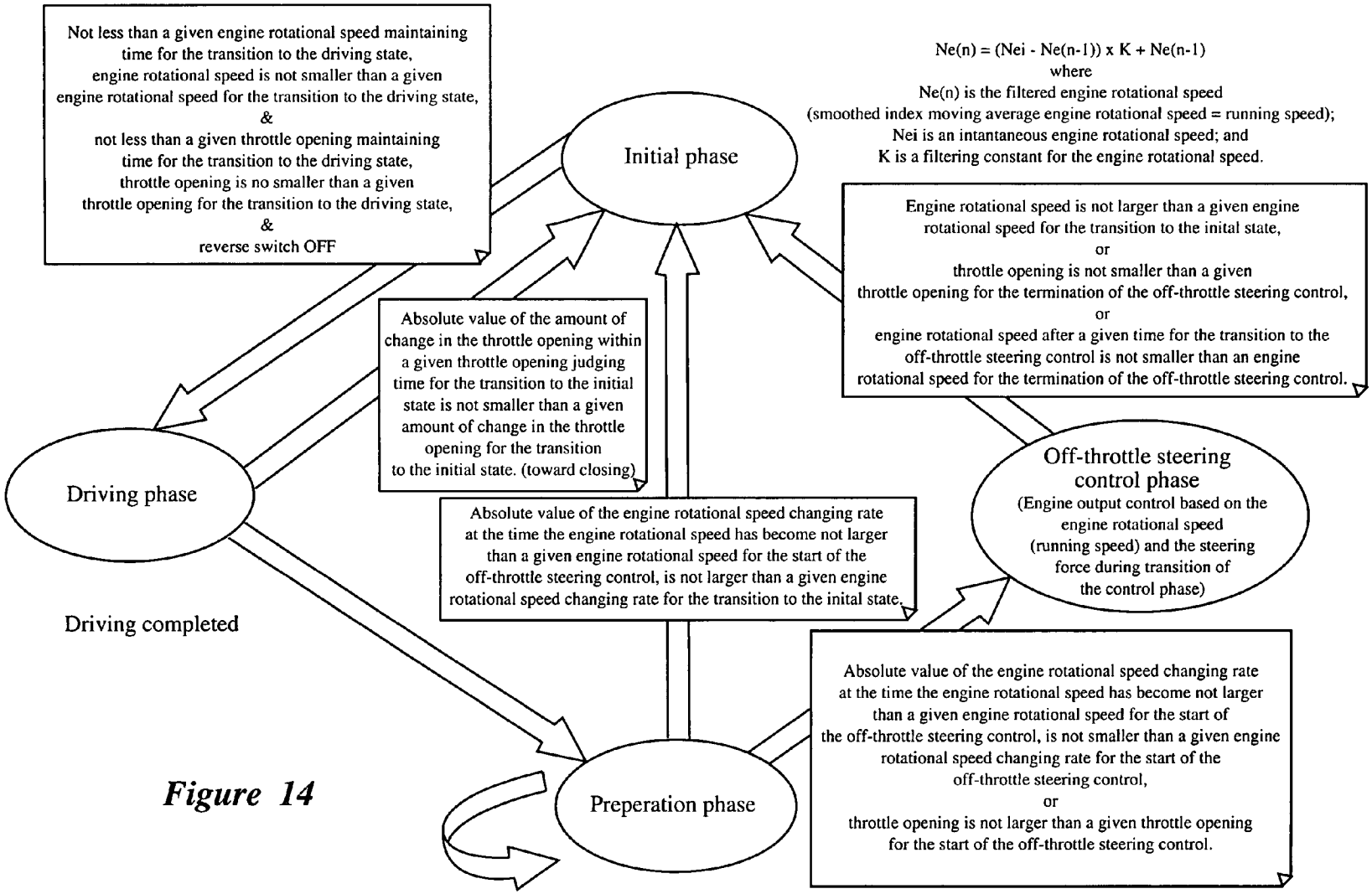
FIG. 14 is another block diagram illustrating an engine management system that uses various input parameters to provide a comfortable watercraft operational environment.

FIG. 14 illustrates another flow diagram of the off throttle steering system according to another preferred embodiment. The flow diagram illustrates how the system moves from one phase to another. The illustrated embodiment uses the throttle motor 226 to control the throttle valve 224, which can control engine speed during off throttle steering. An off-throttle steering situation can be determined using watercraft speed and steering torque.

Detecting an accurate watercraft speed can be challenging because of the varying currents and fluid motion of the water in which the watercraft operates. Due to the challenging nature of detecting accurate watercraft speed, the engine speed can be used to calculate an accurate representation of watercraft speed. The following formula allows the ECU 92 to accurately calculate the watercraft speed according to a measured instantaneous engine speed.

$$N_{(n)}=(Nei-N_{(n-1)})\times K+N_{(n-1)}$$

Where N is a filtered engine rotational speed that is indicative of the watercraft speed, Nei is the instantaneous engine speed, and K is a filtering constant for the instantaneous engine speed. Other equations used to illustrate conditions that need to be met in order for the ECU to determine the correct watercraft operational phase will be explained below. These equations are used throughout the control routine diagrams and are meant to aid in the understanding of the following flow diagram illustrated in FIG. 14 and the control routines illustrated in FIGS. 7–10 and 15 and 16.

N=Filtered engine speed.

$N_D$=Predetermined engine speed for the transition to the Driving Phase.

$|\dot{N}|$=Absolute value of the engine speed changing rate.

$N_N$=Predetermined value of the engine speed for the transition to the Initial Phase.

$\dot{N}_N$=Predetermined engine speed changing rate for the transition to the Initial Phase.

$N_{S1}$=Predetermined engine speed for the start of Off-Throttle Steering control.

$\dot{N}_{S1}$=Predetermined engine speed changing rate for the start of Off-Throttle Steering control.

$N_{S0}$=Predetermined engine speed for the termination of Off-Throttle Steering control.

$T_h$=Throttle opening.

$T_{hD}$=Predetermined throttle opening for the transition to the Driving Phase.

$T_{hN}$=Predetermined throttle opening for the transition to the Initial Phase.

$|\dot{T}_{hN}|$=Absolute value of the rate of change in the throttle opening for the transition to the Initial Phase.

$T_{hS1}$=Predetermined throttle opening for the start of Off-Throttle Steering control.

$T_{hS0}$=Predetermined throttle opening for the termination of Off-Throttle Steering control.

$t_D$=Predetermined time for transition to the Driving Phase.

$t_{S1}$=Predetermined amount of time for the transition to the Off-Throttle Steering control.

The flow diagram of FIG. 14 illustrates four phases of the watercraft 10 and corresponding off-throttle steering control. The watercraft control starts in an initial phase. The initial phase can be defined as a state where the watercraft stays substantially stationary including a range of engine speeds ranging from idle to a predetermined speed. The watercraft begins to move after the predetermined speed is exceeded. From the initial phase, the watercraft can transition into a driving phase. The watercraft can be deemed as in the driving phase when three conditions are met. These three conditions can include (1) when an engine speed Ne: is greater than or equal to a predetermined transition engine speed $N_D$ for a given time $T_D$, as described by the equation: ($N \geqq N_D$) for a given time $T_D$, (2) when a throttle opening $T_h$ is greater than or equal to a predetermined throttle opening $T_{hD}$ for the driving phase for a given time $T_D$, as illustrated by the equation: ($T_h \geqq T_{hD}$), and (3) whenever the reverse switch is open indicating that the watercraft is not in a reverse mode.

According to the control flow diagram illustrated in FIG. 14, the watercraft can either go back to the initial phase or go to a preparation phase. The watercraft can be returned to the initial phase from the driving phase if for example, the absolute value of the rate of change of the throttle angle is greater than or equal to a predetermined throttle angle, $|\dot{T}_{hN}| \geqq T_{hN}$.

The transition from the driving phase to the preparation phase occurs naturally as the operator rides the watercraft. In other words, the driving phase is simply the beginning of the preparation phase. The driving phase and the preparation phase can be considered a single phase after the watercraft operator has reached the predetermined engine speed.

During typical operation the watercraft 10 remains in the preparation phase. The watercraft 10 can transition from the preparation phase back to the initial phase or the watercraft can transition to the off-throttle steering control phase. The watercraft can transition from the preparation phase back to the initial phase, for example, if the absolute value of the engine rotational speed changing rate is less than or equal to a predetermined engine speed changing rate when the instantaneous engine speed falls to a value less than or equal to a predetermined engine speed for the initial phase, as illustrated by the equation $|\dot{N}| \leqq \dot{N}_N$ and $Nei \leqq N_{S1}$. This condition corresponds to a situation where the operator allows the engine speed to fall gradually, and thus, off throttle steering control is not desired.

From the preparation phase, the watercraft can also move to the off-throttle steering control phase. For example, the watercraft can transition from the preparation phase to the off-throttle steering control phase when at least one, for example, of two conditions are met. These conditions can include the following: (1) when an absolute value of engine speed rate of change is greater than or equal to a predetermined engine speed rate $|\dot{N}| \geqq \dot{N}_{S1}$ when the instantaneous engine speed fall to a value below a threshold value for triggering off throttle steering control $Nei \leqq N_{S1}$, and (2) the throttle angle opening is less than or equal to a predetermined throttle angle opening, $T_h \leqq T_{hS1}$. Either of these conditions can be used to determine when an operator quickly releases the throttle lever.

The watercraft can also transition to the initial phase from the off-throttle steering control phase. For example, the system can transition when at least of one of the following three conditions are met: (1) when the smoothed engine speed is less than or equal to a predetermined engine speed, $N \leqq N_N$, (2) when the throttle angle is greater than or equal to a predetermined throttle angle $T_h \geqq T_{hS0}$, or (3) after a predetermined amount of time, the instantaneous engine speed is greater than or equal to a predetermined engine speed, $Nei \geqq N_{S0}$.

The engine speed is controlled to provide a natural feeling off-throttle control through the throttle motor 226. The throttle motor 226 can allow more or less air to enter the combustion chamber 208 in order to increase or decrease engine speed to provide off-throttle steering control and according to an operator's torque request.

Figure 15:
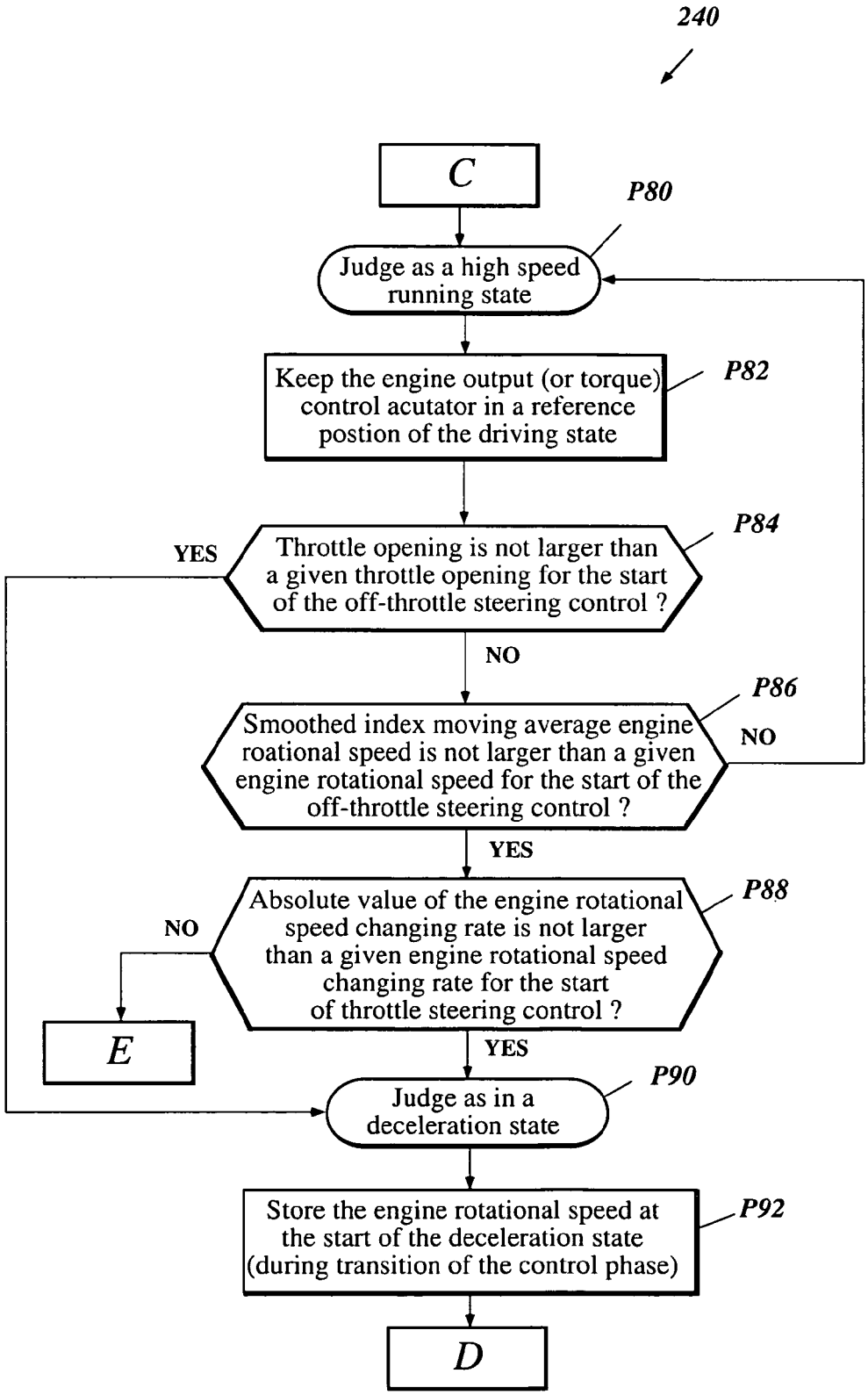
FIG. 15 is a block diagram showing another control routine that can be used with the control system of FIG. 13.
Figure 16:
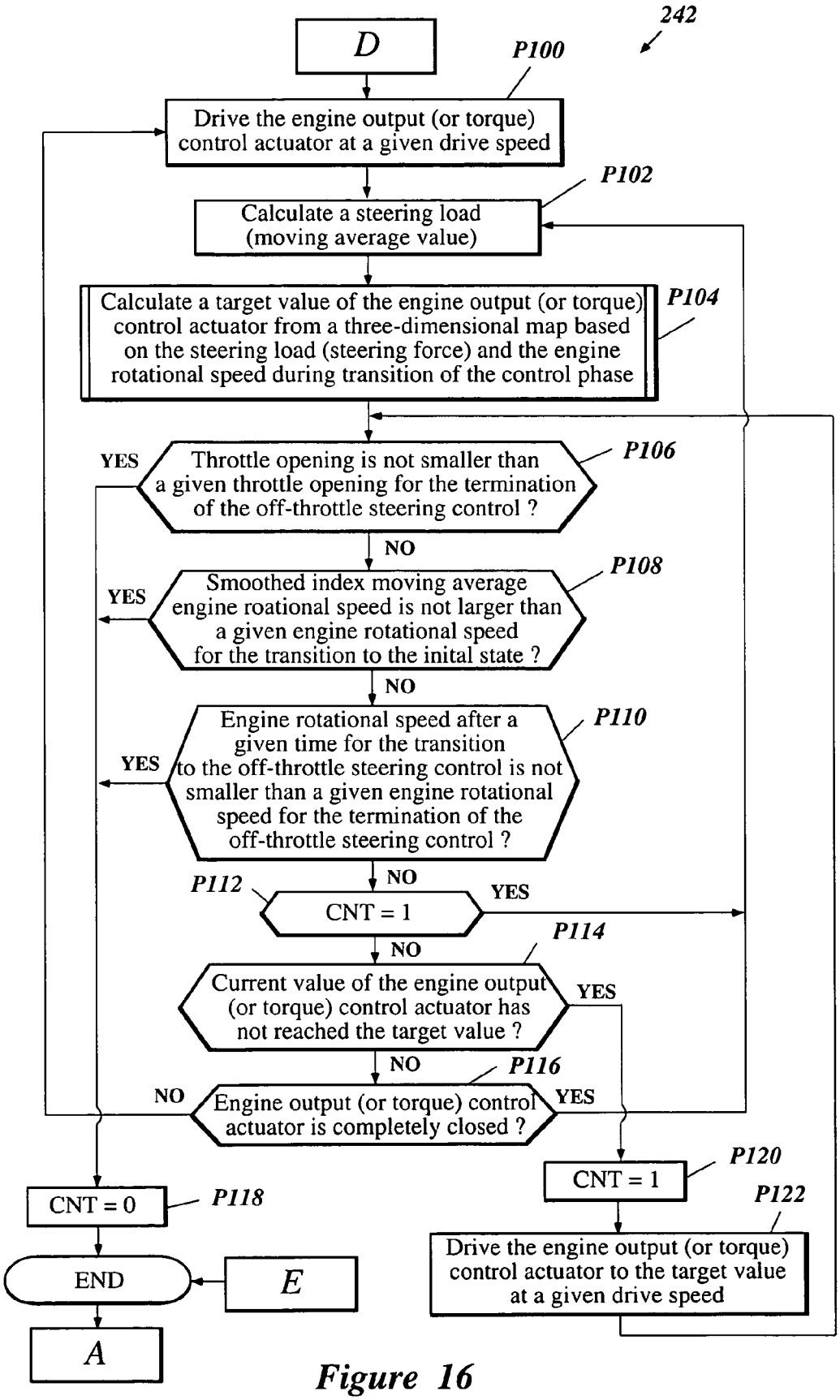
FIG. 16 is a block diagram showing another control routine that can be used with the control system of FIG. 13.

FIGS. 15 and 16 illustrate control routine sections 240 and 242 and are continuations of control routine sections 150 and 152 illustrated in FIGS. 7 and 8. The control routine sections 240 and 242 explain the operation of the motor controlled throttle embodiment described in conjunction with FIGS. 13 and 14. Therefore, the control routine sections 240, 242 illustrated in FIGS. 15 and 16 will be described as continuations from control routine sections 150, 152 illustrated in FIGS. 7 and 8.

With reference to FIG. 15, the control routine section 240 is shown and is arranged and configured in accordance with an embodiment of at least one of the present inventions. The control routine section 240 is continued from the decision block P24 from control routine section 152 illustrated in FIG. 8 and moves to the first operation block P80 where a high speed running state is established. The control routine section 240 then proceeds to an operation block P82.

In operation block P82, the throttle position is kept by the throttle motor at a reference position corresponding to watercraft engine operation in the driving state. The control routine 240 then proceeds to a decision block P84.

In decision block P84 it is determined if $T_h \leqq T_{hS1}$ is true. If in decision block P84 it is determined that $T_h \leqq T_{hS1}$ is not true, the control routine 240 proceeds to a decision block P86. If, however, in decision block P84 it is determined that $T_h \leqq T_{hS1}$ is true, the control routine 240 proceeds to an operation block P90.

In decision block P86 it is determined if $N \leqq N_N$ is true. If in decision block P84 it is determine that $N \leqq N_N$ is not true, the control routine 240 returns to the operation block P80. If, however, in decision block P86 it is determined that $N \leqq N_N$ is true, the control routine 240 proceeds to an decision block P88.

In decision block P88 it is determined if $|\dot{N}| \leqq \dot{N}_{S1}$ is true. In decision block P88 it is determined that $|\dot{N}| \leqq \dot{N}_{S1}$ is not true, the control routine 240 moves to the control routine section 242 and ends. If, however, in decision block P88 it is determined that $|\dot{N}| \leqq \dot{N}_{S1}$ is true, the control routine 240 moves to the operation block P90 where it is determined that the watercraft is in deceleration state.

The control routine 240 then proceeds to an operation block P92 where the engine speed at the start of the deceleration state is stored. The control routine section 240 then proceeds to an operation block P100. Operation block P100 is shown in the continuing control routine section 242 illustrated in FIG. 16.

With reference to FIG. 16, the control routine section 242 is shown and is arranged and configured in accordance with an embodiment of at least one of the present inventions. The control routine 242 moves to the first operation block P100 where the throttle valve 224 controlled by the throttle motor 226 is driven so as to begin to move the throttle valve 224 gradually toward the closed position. The control routine 242 then moves to operation block P102.

In operation block P102, an average value of the steering torque is calculated. The average of the steering torque can be calculated according to data received from the steering torque sensor 36. The control routine 242 then proceeds to an operation block P104.

In operation block P104, a target value of the throttle valve position controlled by the throttle motor is established based on a three-dimensional shown in FIG. 11. The control routine 242 then proceeds to a decision block P106.

In decision block P106, it is determined if the equation $T_h \geqq T_{hS0}$ is true, e.g., has the operator opened the throttle valve sufficiently such that off throttle steering control is not desired. If in decision block P106 it is determined that the equation $T_h \geqq T_{hS0}$ is true, the control routine section 242 proceeds to an operation block P118 where a counter is set to zero. After operation block P118 the control routine 242 ends and returns to decision block P10 in control routine section 150. If however, is decision block P106 it is determined that the equation $T_h \geqq T_{hS0}$ is not true, the control routine section 242 moves to a decision block P108.

In decision block P108, it is determined if $N \leqq N_N$, e.g., has the smoothed engine speed (estimated watercraft speed) fallen to a speed at which off throttle steering control is not desired. If in decision block P108 it is determined that $N \leqq N_N$ is true, the control routine 242 proceeds to the operation block P118. If, however, in decision block P108 it is determined that $N \leqq N_N$ is not true, the control routine 156 proceeds to a decision block P110.

In decision block P110, it is determined if $Nei \geqq N_{S0}$ is true. If in decision block P110 it is determined that $Nei \geqq N_{S0}$ is true, the control routine 242 proceeds to the operation block P118. If however, in decision block P110 it is determined that $Nei \geqq N_{S0}$ is not true, the control routine 242 proceeds to a decision block P112.

In decision block P112, it is determined if the counter is equal to one. If in decision block P112 it is determined that the counter is equal to one, the control routine proceeds to the operation block P102 and repeats. If, however, it is determined in decision block P102 that the counter is not equal to one, the control routine 242 moves to an decision block P114.

In decision block P114, it is determined if the throttle valve motor has reached a target value. In decision block P114, if the throttle valve motor has not reached the target value, the control routine 242 proceeds to a decision block P116.

In the decision block P116, it is determined if the torque control actuator is in a fully closed position. For example, the ECU can determine if the throttle valve 224 is in the closed position. If it is determined that the actuator is not in the fully closed position, the routine 242 returns to operation block P100. If, however, the actuator is in the fully closed position, the routine 242 returns to the operation block P102.

With reference again to decision block P114, if it is determined that the current value of the throttle motor has reached the target value, the control routine 242 proceeds to an operation block P120 where a counter is set to one. The control routine then proceeds to an operation block P122.

In operation block P122, the throttle motor moves the throttle to the target value of an engine speed according to a driver's request that corresponds to a watercraft speed. The control routine 242 then returns to the decision block P106.

Figure 17:
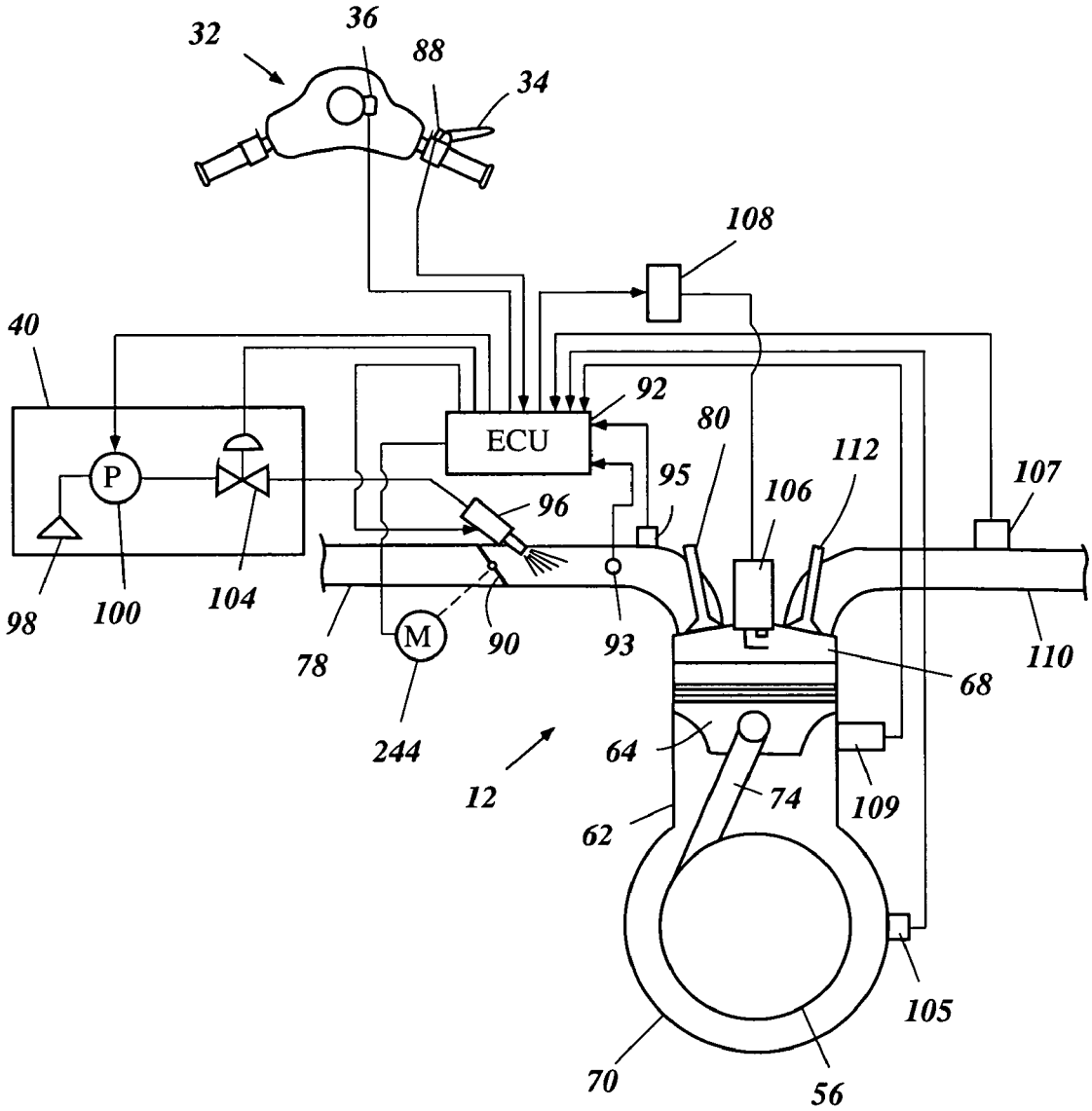
FIG. 17 is a schematic view showing another engine control system, including at least a portion of the engine in cross-section, an ECU, and a simplified fuel injection and simplified steering system.

The engine 12 according to another preferred embodiment of the present invention as illustrated in FIG. 17 operates on a four-stroke cycle combustion principal. The engine 12 illustrated in FIG. 17 is similar to the illustrated embodiment illustrated in FIG. 3, and will therefore not be specifically described except for any differences. The main difference of the preferred embodiment of the engine 12 illustrated in FIG. 17 is a throttle motor 244 that is used to move the position of the throttle 90. The throttle motor 244 illustrated in the preferred embodiment in FIG. 17 is controlled by the ECU 92 according to the throttle lever position sensor 88 and different modes of watercraft operation. One phase of watercraft operation where the ECU 92 can control the throttle position through the throttle motor is the off-throttle steering phase. As was similarly described above with reference to the control routines 150, 152, 240, and 242, the engine 12 illustrated in FIG. 17 includes the throttle motor 244 that is controlled by the ECU 92 during an off-throttle steering phase.

It is to be noted that the control systems described above may be in the form of a hard wired feedback control circuit in some configurations. Alternatively, the control systems may be constructed of a dedicated processor and memory for storing a computer program configured to perform the steps described above in the context of the flowcharts. Additionally, the control systems may be constructed of a general purpose computer having a general purpose processor and memory for storing the computer program for performing the routines. Preferably, however, the control systems are incorporated into the ECU 92, in any of the above-mentioned forms.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, various steps within the routines may be combined, separated, or reordered. In addition, some of the indicators sensed (e.g., engine speed and throttle position) to determine certain operating conditions (e.g., rapid deceleration) can be replaced by other indicators of the same or similar operating conditions. Moreover, not all of the features, aspects and advantages are necessarily required to practice the present invention. Accordingly, the scope of the present invention is intended to be defined only by the claims that follow.

What is claimed is:

1. A method of controlling a marine engine associated with a watercraft having a steering device operable by a rider of the watercraft, an engine, and an engine power output request device operable by a rider of the watercraft, the method comprising determining a deceleration of the watercraft when the watercraft is at an elevated watercraft speed, detecting a steering force applied to the steering device, and controlling the power output of the engine such that the power output of the engine is greater than that corresponding to a state of the power output request device and based on the detected steering force during the deceleration.

2. The method of claim 1, wherein controlling the power output of the engine comprises advancing an ignition timing.

3. The method of claim 1, wherein controlling the power output of the engine comprises opening an idle speed control device such that air flow into the engine is increased.

4. The method of claim 1, wherein determining a deceleration further comprises determining whether the watercraft is operating in a planing mode.

5. The method of claim 4, wherein determining a deceleration further comprises determining if a magnitude of the deceleration is greater than a predetermined deceleration magnitude.

6. The method of claim 1 additionally comprising estimating a watercraft speed based on a speed of the engine.

7. The method of claim 1, wherein controlling the power output of the engine comprises calculating a target power output of the engine based on both a smoothed engine speed value and the detected steering force.

8. The method of claim 7, wherein determining a deceleration comprises detecting at least one of a throttle valve position, a speed of a throttle valve movement, a change in air pressure in an induction system of the engine, and a rate of change of air pressure in the induction system.

9. The method of claim 8, wherein determining a deceleration further comprises at least one of comparing the detected throttle valve position to a predetermined throttle valve position, comparing the detected speed of throttle valve movement to a predetermined throttle valve movement speed, comparing the detected air pressure with a predetermine air pressure, and comparing the detected rate of air pressure change with a predetermine rate of air pressure change.

10. The method of claim 1, wherein the step of detecting a steering force comprises detecting a magnitude of the steering force.

11. The method of claim 1, wherein the step of detecting a steering force comprises detecting a force with which a component of the steering device presses against a force sensor and determining if the steering force falls within a range of steering forces above a steering force caused by an initial contact between the component and the sensor.

12. A method of controlling a marine engine associated with a watercraft having a steering device operable by a rider of the watercraft, an engine, and an engine power output request device operable by a rider of the watercraft, the method comprising determining a deceleration of the watercraft, when the watercraft is at an elevated watercraft speed, detecting a steering force applied to the steering device, and controlling the power output of the engine such that the power output of the engine is greater than that corresponding to a state of the power output request device and based on the detected steering force during the deceleration, wherein controlling the power output of the engine further comprises varying the engine power output in accordance with variations in the steering force.

13. A method of controlling a marine engine associated with a watercraft having a steering device operable by a rider of the watercraft, an engine, and an engine power output request device operable by a rider of the watercraft, the method comprising determining a deceleration of the watercraft when the watercraft is at an elevated watercraft speed, detecting a steering force applied to the steering device, and controlling the power output of the engine such that the power output of the engine is greater than that corresponding to a state of the power output request device and based on the detected steering force during the deceleration, wherein controlling the power output of the engine further comprises increasing the engine power output in response to increases in steering force.

14. A watercraft comprising a hull, a steering device operable by a rider of the watercraft, an engine, an engine power output request device operable by a rider of the watercraft, and a controller configured to determine a deceleration of the watercraft when the watercraft is at an elevated watercraft speed, to detect a steering force applied to the steering device, and to control the power output of the engine such that the power output of the engine is greater than that corresponding to a state of the power output request device and based on the detected steering force during the deceleration.

15. The watercraft of claim 14, wherein the engine further comprises an induction system including a throttle valve configured to meter an amount of air moving through the induction system, the controller including an actuator configured to control movement of the throttle valve.

16. The watercraft of claim 14, wherein the engine further comprises an induction system including a throttle valve configured to meter an amount of air moving through the induction system, and a bypass system configured to guide air so as to bypass the throttle valve, the controller including an actuator configured to meter an amount of air moving through the bypass system.

17. The watercraft of claim 16, wherein the controller is configured to adjust the actuator to provide the power output from the engine that is greater than that corresponding to the state of the power output request device.

18. The watercraft of claim 14, wherein the controller is configured to determine the deceleration by detecting at least one of a rate of change of a speed of the engine, a change in a throttle valve position, a speed of closing movement of the throttle valve, a change in air pressure in an induction system of the engine, and a rate of change in the air pressure in the induction system.

19. The watercraft of claim 18, wherein the controller is further configured to determine the deceleration by performing at least one of a comparison of the detected rate of change of the engine speed with a predetermined rate of engine speed change, a comparison of the detected change in throttle valve position with a predetermined throttle valve position change, a comparison of the detected speed of closing movement of the throttle valve with a predetermined speed of closing movement of the throttle valve, a comparison of the detected change in air pressure with a predetermined change in air pressure, and a comparison of the detected rate of change in air pressure with a predetermined rate of change in air pressure.

20. The watercraft of claim 14, wherein the controller is configured to compare the determined deceleration with a predetermined deceleration value and to control the power output of the engine in accordance with the state of the power output request device if the determined deceleration is less than the predetermined deceleration value.

21. The watercraft of claim 14, wherein the steering device comprises a handle bar mounted to a rotatable steering shaft, at least one stop configured to limit the rotational movement of the shaft, and a sensor configured to detect a force at which the steering shaft applies against the at least one stop.

22. The watercraft of claim 14, wherein the controller is configured to vary the power output from the engine in accordance with variations in the detected steering force.

23. The watercraft of claim 14 additionally comprising a steering force sensor assembly, the steering device being configured to move a member into contact with the steering force sensor assembly when the steering device is turned toward its maximum turning positions, wherein the controller is configured to determine when the detected steering force has been raised beyond a steering force corresponding to the force generated by the initial contact of the member with the steering sensor assembly and to raise the power output from the engine in accordance with the magnitude of the steering force beyond that produced by the initial contact of the member with the steering force sensor.

24. A watercraft comprising a hull, a steering device operable by a rider of the watercraft, an engine, an engine power output request device operable by a rider of the watercraft, means for determining a deceleration of the watercraft when the watercraft is at an elevated watercraft speed, a sensor for detecting a steering force applied to the steering device, and means for controlling the power output of the engine such that the power output of the engine is greater than that corresponding to a state of the power output request device and based on the detected steering force during deceleration.

25. The watercraft of claim 24 additionally comprising means for varying the power output from the engine over a range of power output magnitudes in accordance with a range of variations in the detected steering force.

* * * * *

UNITED STATES PATENT AND TRADEMARK OFFICE

CERTIFICATE OF CORRECTION

PATENT NO. : 7,160,158 B2
APPLICATION NO. : 10/862267
DATED : January 9, 2007
INVENTOR(S) : Yoshimasa Kinoshita It is certified that error appears in the above-identified patent and that said Letters Patent is hereby corrected as shown below:

On Page 2, in Column 1, Line 25 (U.S. Patent Documents), after "6,478,638", please delete "B1" and insert -- B2 --, therefor.

On Page 2, in Column 1, Line 28 (U.S. Patent Documents), please delete "Simzrd" and insert -- Simard --, therefor.

In Sheet 5 of 17 (Figure 5), Line 5 (Right Hand Side), please delete "intantaneous" and insert -- instantaneous --, therefor.

In Sheet 5 of 17 (Figure 5), Line 8 (Right Hand Side), please delete "inital" and insert -- initial --, therefor.

In Sheet 5 of 17 (Figure 5), Line 5 (Middle Rectangle Box), please delete "inital" and insert -- initial --, therefor.

In Sheet 5 of 17 (Figure 5), Line 1 (Middle Oval Box), please delete "Preperation" and insert -- Preparation --, therefor.

In Sheet 9 of 17 (Figure 9), Line 2 (Reference Box P32), please delete "acutator" and insert -- actuator --, therefor.

In Sheet 9 of 17 (Figure 9), Line 3 (Reference Box P32), please delete "postion" and insert -- position --, therefor.

In Sheet 9 of 17 (Figure 9), Line 4 (Reference Box P36), please delete "steeering" and insert -- steering --, therefor.

In Sheet 9 of 17 (Figure 9), Line 2 (Reference Box P38), please delete "roational" and insert -- rotational --, therefor.

Signed and Sealed this

Eighteenth Day of May, 2010

David J. Kappos

David J. Kappos
*Director of the United States Patent and Trademark Office*

In Sheet 10 of 17 (Figure 10), Line 2 (Reference Box P68), please delete "roational" and insert -- rotational --, therefor.

In Sheet 10 of 17 (Figure 10), Line 4 (Reference Box P68), please delete "inital" and insert -- initial --, therefor.

In Sheet 12 of 17 (Figure 12), Line 6 (Left Hand Side), please delete "intial" and insert -- initial --, therefor.

In Sheet 14 of 17 (Figure 14), Line 5 (Right Hand Side), please delete "intantaneous" and insert -- instantaneous --, therefor.

In Sheet 14 of 17 (Figure 14), Line 8 (Right Hand Side), please delete "inital" and insert -- initial --, therefor.

In Sheet 14 of 17 (Figure 14), Line 1 (Middle Oval Box), please delete "Preperation" and insert -- Preparation --, therefor.

In Sheet 15 of 17 (Figure 15), Line 2 (Reference Box P82), please delete "acutator" and insert -- actuator --, therefor.

In Sheet 15 of 17 (Figure 15), Line 3 (Reference Box P82), please delete "postion" and insert -- position --, therefor.

In Sheet 15 of 17 (Figure 15), Line 2 (Reference Box P86), please delete "roational" and insert -- rotational --, therefor.

In Sheet 16 of 17 (Figure 16), Line 2 (Reference Box P108), please delete "roational" and insert -- rotational --, therefor.

In sheet 16 of 17 (Figure 16), Line 4 (Reference Box P108), please delete "inital" and insert -- initial --, therefor.

In Column 4, Line 39 (Approx.), after "section", please insert -- 18. --, therefor.

In Column 19, Line 28, please delete "Ne:" and insert -- Nei --, therefor.

In Column 23, Lines 47-48, in Claim 12, please delete "watercraft," and insert -- watercraft --, therefor.